US005168286A

United States Patent [19]

Okauchi et al.

[11] Patent Number: 5,168,286

[45] Date of Patent: Dec. 1, 1992

[54] ELECTROPHOTOGRAPHIC IMAGE FORMING APPARATUS AND A THERMAL PRINTER FOR SUCH APPARATUS FOR ADDING SUPPLEMENTAL DATA

[75] Inventors: Yoshifumi Okauchi, Sakai; Hideo Umezawa, Amagasaki; Satoshi Yano, Takatsuki; Yutaka Shigemura, Takarazuka; Takashi Kondo, Sakai; Yukihiro Ito, Osaka; Mitsuharu Yoshimoto, Nara; Junichi Oura, Hirakata; Seiichi Shirasaki, Neyagawa; Yoshitake Miyoshi, Kyoto; Takashi Miyake, Hirakata, all of Japan

[73] Assignee: Mita Industrial Co., Ltd., Osaka, Japan

[21] Appl. No.: 569,019

[22] Filed: Aug. 17, 1990

[30] Foreign Application Priority Data

Aug. 18, 1989 [JP] Japan ..... 1-213402
Aug. 18, 1989 [JP] Japan ..... 1-213403
Aug. 18, 1989 [JP] Japan ..... 1-213404

[51] Int. Cl.[5] ..... B41M 5/00

[52] U.S. Cl. ..... 346/76 PH; 355/202; 400/120; 400/234

[58] Field of Search ..... 346/76 PH; 400/120, 400/120 HE, 234, 235, 719; 355/202, 285, 289, 290

[56] References Cited

U.S. PATENT DOCUMENTS 3,774,538 11/1973 Bullock ..... 346/76 PH X
4,092,099 5/1978 Chiba et al. ..... 219/216 X
4,545,671 10/1985 Anderson ..... 355/309 X
4,642,656 2/1987 Shibuya et al. ..... 346/76 PH
4,659,927 4/1987 Tago et al. ..... 219/216 X
4,754,290 6/1988 Kitayama et al. ..... 346/76 PH
4,780,742 10/1988 Takahashi et al. ..... 219/216 X
4,970,531 11/1990 Shimizu et al. ..... 346/76 PH
5,026,276 6/1991 Hirabayashi et al. ..... 355/282 X

FOREIGN PATENT DOCUMENTS 0077459 5/1984 Japan ..... 355/202
0053665 3/1986 Japan ..... 355/202
0068277 4/1986 Japan .
0072570 4/1986 Japan ..... 400/234
0255886 11/1986 Japan ..... 400/234
0051167 3/1988 Japan ..... 400/120 HE

*Primary Examiner*—A. T. Grimley
*Assistant Examiner*—J. E. Barlow, Jr.
*Attorney, Agent, or Firm*—Antonelli, Terry, Stout & Kraus

[57] ABSTRACT

An image forming apparatus having a main body with an opening portion provided in one face of the main body, and a thermal transfer printer. The thermal transfer printer records desired information additively on paper on which a toner image has been fixed. The printer uses a thermal head to press an ink-ribbon on the paper. The thermal transfer printer includes a casing in which a cassette for housing the ink-ribbon is detachably mounted, a thermal head support for supporting the thermal head, and an interlocking mechanism. The interlocking mechanism retracts the thermal head with the thermal head support in response to retraction of the casing. Thus, it is possible to detach the cassette from the main body through the opening portion. This facilitates replacement of cassettes and clearing of paper jams.

44 Claims, 19 Drawing Sheets

ELECTROPHOTOGRAPHIC IMAGE FORMING APPARATUS AND A THERMAL PRINTER FOR SUCH APPARATUS FOR ADDING SUPPLEMENTAL DATA

BACKGROUND OF THE INVENTION

The present invention relates to an image forming apparatus including a thermal transfer printer for additively entering specific information, such as characters, that an original image does not include onto paper on which an image corresponding to an original image has been transferred and formed.

In some cases, it is necessary to make notes of such items as copy date, copier's name, and so forth on the paper on which an image forming apparatus, such as an electrostatic copying machine, has formed an image.

In such cases, it is troublesome to enter such notes by handwriting or stamping. There is known an image forming apparatus in which, to eliminate such troubles, such operation is automatically performed inside the body of the apparatus.

Such image forming apparatus is provided with a thermal transfer printer. In the thermal transfer printer, a casing, in which a cassette housing an ink-ribbon and a thermal head are attached, is supported by a pair of frame side plates, and a thermal head applies pressure through the ink-ribbon to paper passing a platen roller, thereby to heat and transfer characters and such onto the paper. Heat-meltable ink is on the ink-ribbon, and the ink is transferred to the paper with heat generated by the thermal head.

In such an image forming apparatus, however, a cassette whose ink-ribbon is used up is removed for replacement through a hole provided at the center of either of the frame side plates by a hand inserted through the hole after sliding the cassette in the axial direction of the platen roller.

In such an image forming apparatus it is difficult to replace a used ink-ribbon with a new one because the hole through which the used ink-ribbon must be replaced is narrow.

Furthermore, that the cassette is mounted in the vicinity of the thermal head in the casing makes the replacement of the cassette even more difficult. At the same time, there is a problem that a paper jam that may occur near the thermal transfer printer is difficult to clear.

Because the ink-ribbon is always placed near a passage through which hot paper passes, the ink-ribbon in such a thermal transfer printer rapidly deteriorates due to the heat and the like, although thermal transferring is performed only when it is necessary. In this connection, there is known a thermal transfer printer in which thermal transfer is performed while the thermal head is extending the ink-ribbon between a feed reel and a winding reel of the cassette, and after completion of the thermal transfer, slack of the ink-ribbon, stemming from the retraction of the thermal head, is eliminated, thus keeping the ink-ribbon away from the hot paper passage for the purpose of preventing such deterioration of the ribbon (see, for example, Japanese Laid-open Patent Application No. 297085/1988).

Meanwhile in thermal transferring, frictional force between the paper and the ink-ribbon is sufficiently greater than frictional force between the ink-ribbon and the thermal head (see, for example, Japanese Laid-open Patent Application No. 212977/1983). Therefore there is no relative shifting of the paper and the ink-ribbon. Accordingly, the ink-ribbon is wound from the feed reel by the length the thermal head travels.

There has not been proposed so far any invention or device wherein the length of the ink-ribbon to be wound is precisely regulated when winding the ink-ribbon in thermal transfer operations or when winding the slackened ink-ribbon after completion of thermal transfer.

When a relatively new ink-ribbon is drawn out from a feed reel and wound on a winding reel, the winding reel with the ribbon wound thereon has a smaller diameter than the feed reel with the ribbon wound thereon. On the other hand, when the ink-ribbon comes near to the end of its use, the winding reel with the ribbon wound thereon has a larger diameter than the feed reel with the ribbon wound thereon. Accordingly, if the winding reel rotates for a given period of time through a predetermined angle, the amount of the ribbon wound on the winding reel in the beginning differs considerably from the amount of the ribbon wound on the reel toward the end of its use. In other words, when the ink-ribbon is relatively new, the feed reel with the ribbon wound thereon has a larger diameter, and as the ink-ribbon is used, the diameter of the feed reel with the ribbon wound thereon becomes smaller.

The ink-ribbon is wound on the winding reel in thermal transferring, or the slackened ink-ribbon after thermal transferring is wound on the winding reel or the feed reel. In such cases, the amount of rotation of the reel to wind the ribbon on the reel differs depending on whether the ink-ribbon is new or has come near to the end of its use. If the amount of time the ribbon winds on the reel is adjusted for the case of a new ink-ribbon, there occurs the problem that as the ribbon draws near to the end of its use, the winding length onto the winding reel increases so that excess ribbon is wound on the winding reel. Also when the slackened ribbon is wound on the winding reel or the feed reel, excess ribbon is wound on the reel, or the winding amount is not sufficient to eliminate the ribbon slack.

In a thermal transfer printer as disclosed in Japanese Laid-open Patent Application No. 297085/1988, when the winding reel stops winding ribbon thereon, a tension spring urges the feed reel to turn by a predetermined angle in the direction opposite to the winding direction, thereby eliminating the ribbon-slack by winding the ribbon on the feed reel.

That thermal transfer printer, however, still suffers the same problem as described above in that the ribbon slack cannot be eliminated, even though the feed reel is turned by a predetermined angle in the opposite direction. If the amount of ribbon wound on the feed reel is small, the feed reel does not have a great enough diameter to wind the ribbon by a sufficient length to eliminate the slack.

In order to ensure the elimination of the ribbon slack even when the feed reel has a small amount of ribbon wound thereon, as mentioned above, the tension spring is adapted to urge the feed reel to turn by a larger angle.

In this structure, however, if the feed reel has a large amount of ribbon wound thereon, the ink-ribbon is always subject to tension after the slack is eliminated. This tension causes deterioration of the ink-ribbon.

In addition, because thermal transfer is performed with pressure of the ink-ribbon against the paper which is still very hot immediately after a fixing device has heated and fixed an image thereon, and because the ambient temperature around the thermal transferring device is very high, such image forming apparatus suffers the problem that the desired thermal transfer cannot be achieved because of the ink-ribbon melting in other locations than the pattern to be heated and transferred.

To cope with the above problem, it may be suggested that the paper discharged from the fixing device be exposed to air from a fan, thereby to cool the paper. However, if a fan is operated in the vicinity of the fixing device, the fan circulates air which has become hot due to the heat of the fixing device within the space between the pair of frame side plates, reducing the efficiency of cooling down the paper. At the same time, the fixing device is deprived of its heat for fixing, resulting in poor heating and fixing of an image.

SUMMARY OF THE INVENTION

It is a first object of the present invention to provide an image forming apparatus which in consideration of the above problems, facilitates the replacement of cassettes and the clearing of jams.

This first object is accomplished by the following image forming apparatus:

The image forming apparatus has a main body provided with a paper discharge portion in the side face thereof and an opening portion provided in the side face, an opening and shutting means for opening and shutting the opening portion, and a thermal transfer printer for recording desired information on paper, on which a fixing means has fixed a toner image and which is on a platen roller, by using a thermal head to press the ink-ribbon on the paper. The thermal transfer printer includes a cassette for housing the ink-ribbon, a casing, a thermal head supporting means, and an interlocking mechanism. The casing is detachably provided with the cassette and is movable between a set position, to be set in a predetermined position in the main body of the image forming apparatus, and a retracted position, retracted from the set position, so as to allow the cassette to be removed through the opening portion which is kept open by the opening and shutting means. The thermal head supporting means supports the thermal head so that the thermal head is movable between a pressuring position, to press the ink-ribbon to the paper while extending the ink-ribbon from the cassette for thermal transferring, and a retracted position, retracted from the pressuring position so as to allow removal of the cassette from the casing. The interlocking mechanism retracts the thermal head to its retracted position by means of the thermal head supporting means in response to movement of the casing to its retracted position.

In the above-mentioned structure, the casing is moved to its retracted position by a hand inserted inside the main body of the image forming apparatus through the opening portion as the opening portion is kept open by the opening and shutting means. Corresponding to this, the interlocking mechanism retracts the thermal head to the retracted position of the thermal head. The thermal head in the retracted position allows the cassette to be detached from the casing. The casing in the retracted position allows the detached cassette to be removed through the opening portion of the main body of the image forming apparatus. Therefore, the cassette is in a condition to be easily removed from the main body of the image forming apparatus.

It is a second object of the present invention to provide an image forming apparatus which ensures elimination of the slackened ink-ribbon of a thermal transfer printer without deterioration of the ink-ribbon.

The second object is accomplished by the following image forming apparatus:

The image forming apparatus has a thermal transfer printer for recording desired information additively on a paper on which a fixing means has fixed a toner image by pressing an ink-ribbon to the paper. This thermal transfer printer comprises a cassette for housing the ink-ribbon, a thermal head, a slack eliminating means, a torque limiter, and a resistance loading means. The cassette has a feed reel for feeding out the ink-ribbon and a winding reel for winding thereon of the ink-ribbon. For thermal transferring, the thermal head moves to a pressuring position to press the ink-ribbon, which is running between the feed reel and the winding reel, onto the paper on a platen roller while extending the ink-ribbon from the cassette, and then after thermal transfer moves to a pressure release position to stop pressing of the ink-ribbon. The slack eliminating means actuates the winding reel to wind the ink-ribbon on the winding reel after completion of thermal transferring, thus eliminating the slack brought about by the thermal head moving to the pressure release position. The torque limiter intervenes between the winding reel and the slack eliminating means and restrains the slack eliminating means from transmitting more than a predetermined amount of drive torque to the winding reel. The resistance loading means loads on the feed reel a braking torque greater than the predetermined torque of the torque limiter.

In the above-described structure, the slack eliminating means eliminates the slack of the ink-ribbon by having the winding reel wind the ink-ribbon thereon after completion of the thermal transferring and tensions the ink-ribbon between the winding reel and the feed reel. At this time, the braking torque of the resistance loading means is loaded on the winding reel via the feed reel and the ink-ribbon tension. However, the winding reel is controlled not to accept torque greater than a predetermined torque, and because the braking torque is greater than the predetermined torque unused ink-ribbon is not drawn out from the feed reel to be fed to the winding reel.

Meanwhile, when the ink-ribbon running between the feed reel and the winding reel is extended from the cassette by the thermal head during thermal transferring, the ink-ribbon wound on the winding reel on eliminating the ribbon slack is wound out from the winding reel, because as in the case of eliminating the ribbon slack, frictional braking torque loaded on the feed reel is greater than the predetermined torque of the torque limiter.

The second object is accomplished by the following image forming apparatus as well:

The image forming apparatus is provided with a thermal transfer printer for recording desired information additively on a paper on which a fixing means has fixed a toner image by pressing an ink-ribbon to the paper. This thermal transfer printer comprises a cassette for housing the ink-ribbon, a thermal head, a slack eliminating means, a torque limiter, and a resistance loading means. The cassette has a feed reel for feeding out the ink-ribbon and winding reel for winding the fed ink-ribbon thereon. The thermal head moves to a pressuring position for thermal transferring to press the ink-ribbon, which is running between the feed reel and the winding reel, onto the paper on a platen roller while extending the ink-ribbon from the cassette, and then after thermal transferring moves to a pressure release position to release pressuring of the ink-ribbon. The slack eliminating means drives the feed reel to wind the ink-ribbon on the feed reel after thermal transferring, thus eliminating slack resulting from the thermal head moving to the pressure release position. The torque limiter intervenes between the feed reel and the slack eliminating means and restrains the slack eliminating means from transmitting more than a predetermined amount of drive torque to the feed reel. The resistance loading means loads braking torque greater than that predetermined torque on the feed reel.

In the above-described structure, the slack eliminating means rotates the feed reel to eliminate the ribbon slack brought about by the thermal head moving to the pressure release position after completion of thermal transferring. At this time, the torque limiter regulates so that less than a predetermined value of drive torque is transmitted from the slack eliminating means to the feed reel, and the resistance loading means loads braking torque greater than the predetermined torque on the winding reel, and therefore the ribbon slack is certain to be eliminated. Furthermore, there never occurs such an error as winding out unnecessary ink-ribbon from the winding reel. Thus the slackened portion of the ink-ribbon is wound on the feed reel, and in the next thermal transfer the portion wound on the feed reel is wound out again by the thermal head moving to the pressuring position. Accordingly, used ink-ribbon is never repeatedly used.

It is a third object of the present invention to provide an image forming apparatus in which in winding an ink-ribbon in a thermal transfer printer, the amount of the ink-ribbon wound can be limited to a specific amount.

This third object can be accomplished by the following image forming apparatus:

The image forming apparatus is provided with a thermal transfer printer for recording desired information additively on a paper on which a fixing means has fixed a toner image by pressing an ink-ribbon on the paper. This thermal transfer printer comprises a winding control means for controlling a winding reel to wind thereon ink-ribbon fed from a feed reel. This winding control means comprises a ribbon amount detection means for outputting a signal proportional either to the amount of the ink-ribbon remaining on the feed reel or to the amount of the ink-ribbon wound on the winding reel, and a winding time control means for changing the operation time for the winding reel to wind thereon ink-ribbon according to the output from the ribbon amount detection means.

In the above-described structure, the ribbon amount detection means outputs a signal proportional either to the amount of the ink-ribbon remaining on the feed reel or to the amount of the ribbon wound on the winding reel, and based on this signal, the operation time of the winding reel is controlled. Thus, the winding reel is adapted to wind a uniform length of the ink-ribbon thereon at any time.

It is a fourth object of the present invention to provide an image forming apparatus which enables preferable thermal transferring by effectively cooling the paper used for the thermal transfer, without deteriorating the heating efficiency of the fixing device.

This fourth object can be accomplished by the following image forming apparatus:

The image forming apparatus is provided with a thermal transfer printer for recording desired information additively on a paper on which a fixing means has fixed a toner image by pressing an ink-ribbon on the paper. The image forming apparatus comprises a pipe of good heat conductivity, both ends of which are supported by a pair of side plates and both ends of which communicate with space outside of the side plates; a pressuring means for interposing paper discharged from a fixing device into a clearance between the pressuring means and the circumference of the pipe, thus pressuring the paper on the circumference of the pipe; a drive means for driving either the pipe or the pressuring means so as to have the pipe and the pressuring means deliver the paper to the thermal transfer printer; and a ventilating means for allowing external air to flow inside of the pipe.

In the above-described structure, the pipe and the pressuring means for pressing the full width of the paper to the periphery of the pipe jointly deliver the paper to the thermal transfer printer. Because the pipe on which the paper is pressed has good heat conductivity and both pipe ends of the pipe communicate with the outside of the side plates, and because the ventilating means passes relatively cool air from outside of the side plates into the pipe, paper can be effectively cooled through the pipe before the thermal transfer takes place.

DESCRIPTION OF THE PREFERRED EMBODIMENT

Detailed description will be given with reference to the accompanying drawings showing preferred embodiments.

Figure 1:
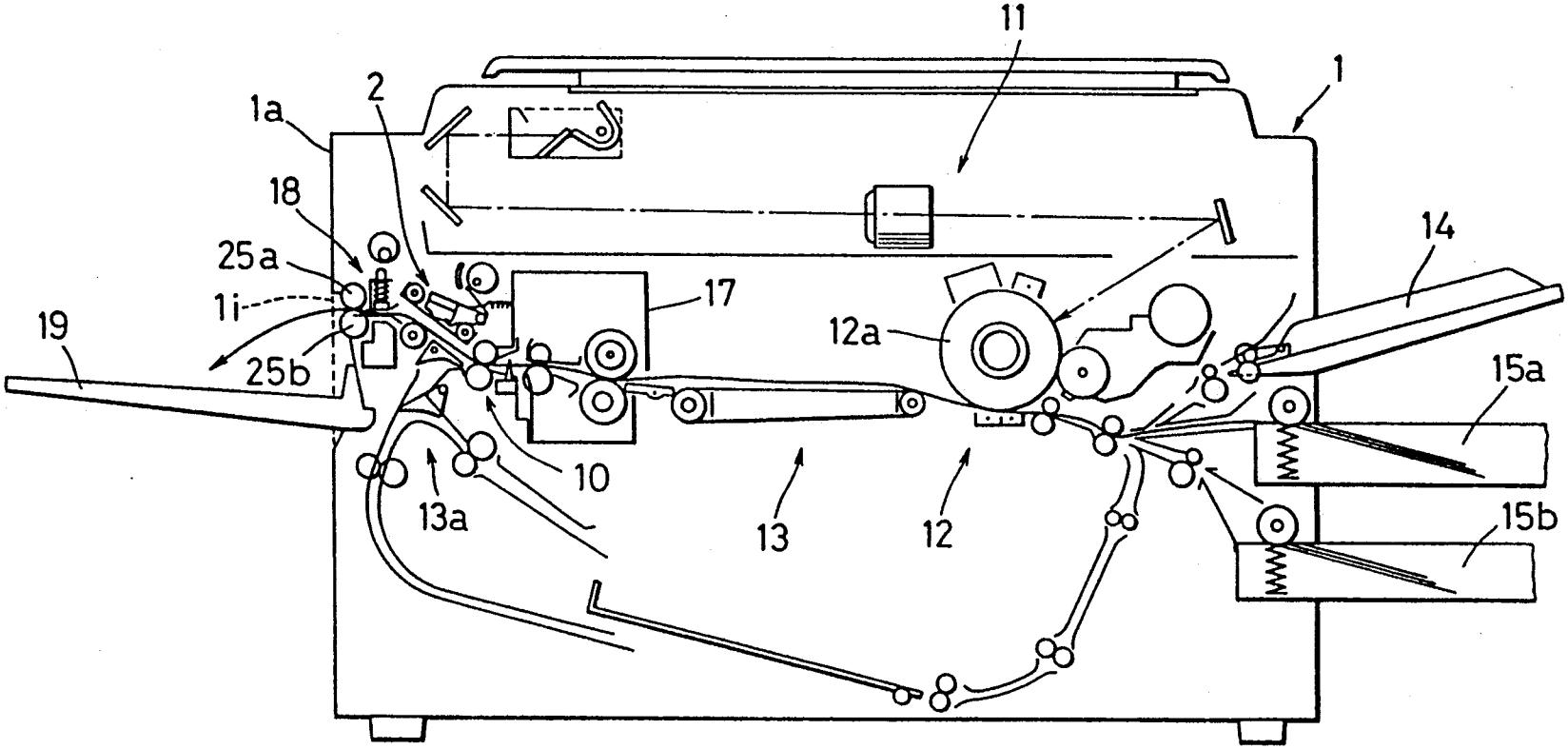
FIG. 1 is a schematic view illustrating the whole body of a copying machine.

Referring to FIG. 1, the copying machine of this embodiment includes an optical system 11, a copying processing portion 12 and a paper delivery portion 13 inside of the main body 1 of the copying machine.

The optical system forms an electrostatic latent image on a photosensitive material 12*a*, the electrostatic latent image corresponding to an original image. The copy processing portion 12 develops the electrostatic latent image into a toner image and transfers it onto paper to form a copy image thereon. The paper delivery portion 13 discharges paper fed from a manual paper feeding portion 14 or a paper feeding cassette 15*a* or 15*b* onto a discharge tray 19 of a paper discharge portion after successively conveying the paper by way of copy processing portion 12, a fixing device 17 for heating and fusing the image on the paper, thermal transfer printer 2, and punching unit 18. Between the fixing device 17 and the thermal transfer printer 2, there is provided a paper cooling mechanism 10 for cooling the paper discharged from the fixing device 17 and for delivering the paper to the thermal transfer printer 2.

Figure 2:
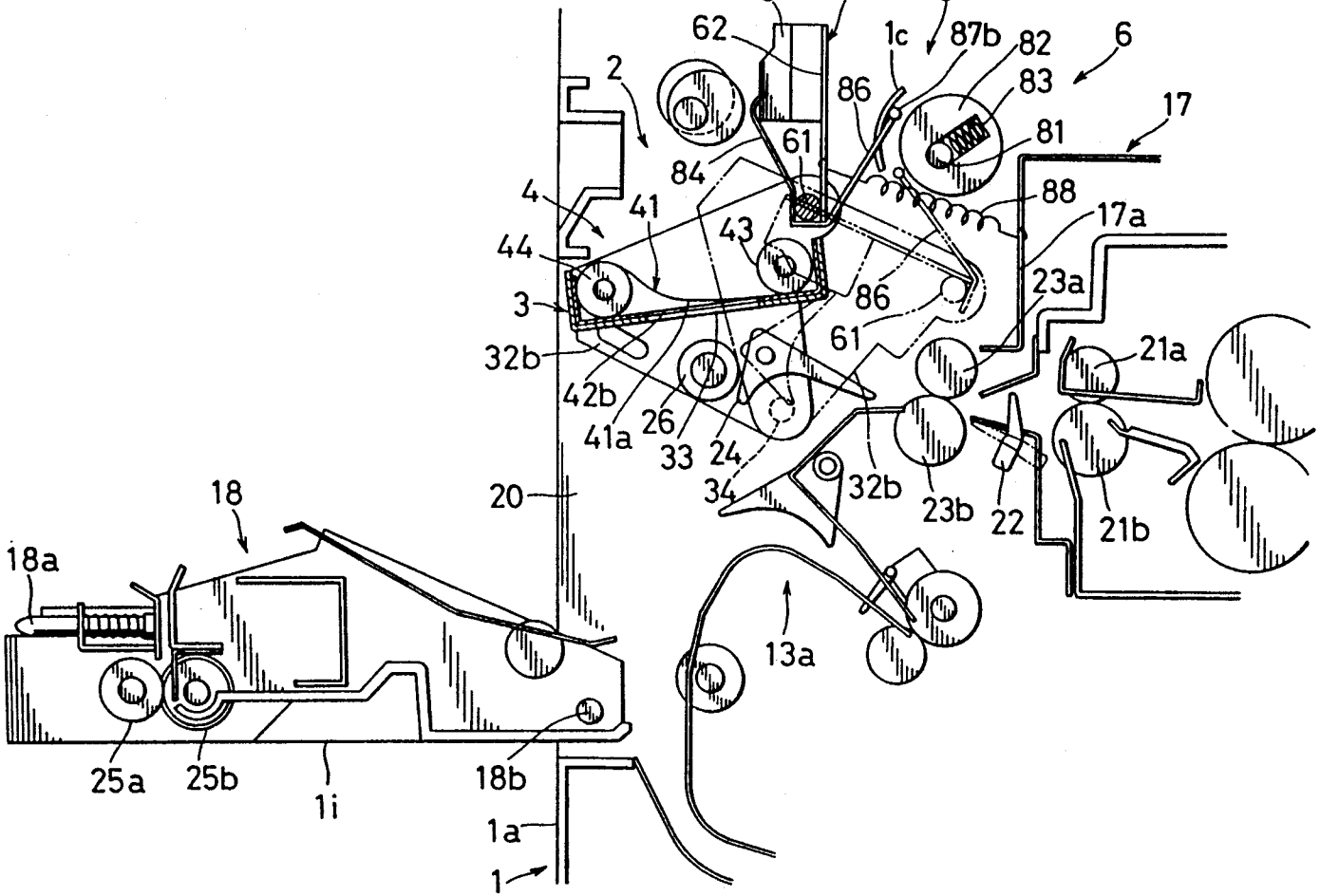
FIG. 2 is a side view illustrating the main portion of a copying machine with the casing of a thermal transfer printer in a retracted position.
Figure 3:
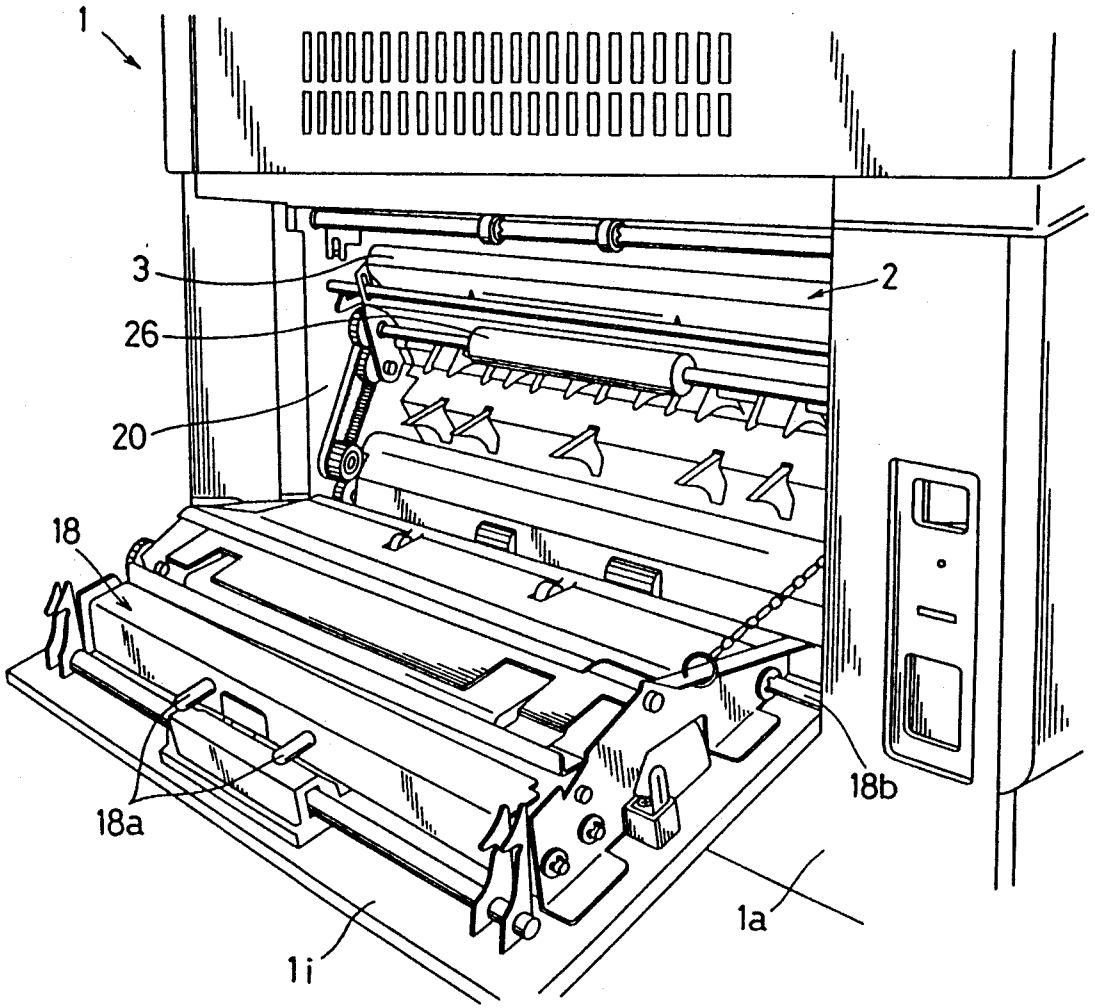
FIG. 3 is a perspective view showing the side face of the main body of a copying machine with a punching unit when the side face is opened.
Figure 18:
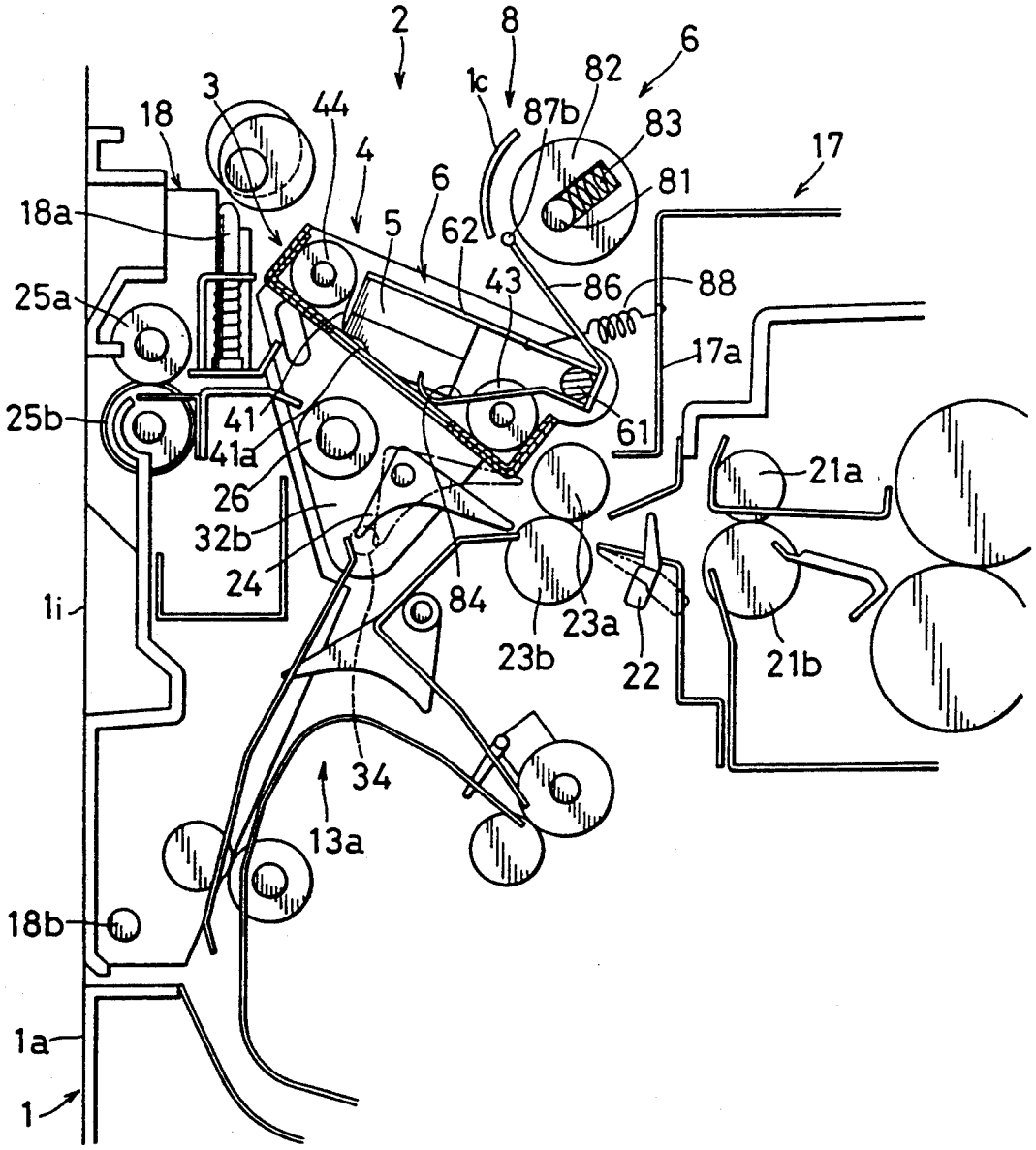
FIG. 18 is a schematic side view of a copying machine in a state where the thermal head of a thermal transfer printer is in a pressing position.

The punching unit 18 is disposed between the thermal transfer printer 2 and the side face 1*a* of the main body 1 of the copying machine. The punching unit 18 is mounted on a cover 1*i*covering an opening portion 20 of the side face 1*a*. The punching unit 18 presses punching cutters 18*a* (FIG. 2) into the trailing edge of the paper which has passed through the thermal transfer printer 2, thus punching a plurality of holes for filing of the paper. As shown in FIGS. 2 and 3, the punching unit 18 is pivoted on a shaft 18*b* in the lower end thereof main body 1 of the copying machine (counter-clockwise in FIG. 2), thereby to expose the opening portion 20 in the side face 1*a* of the main body 1 of the copying machine. Through this opening portion 20, maintenance of the thermal transfer printer 2 can be performed. As shown in FIG. 18, the punching unit 18 and the cover 1*i* normally close the opening portion 20 on side face 1*a*.

Figure 4:
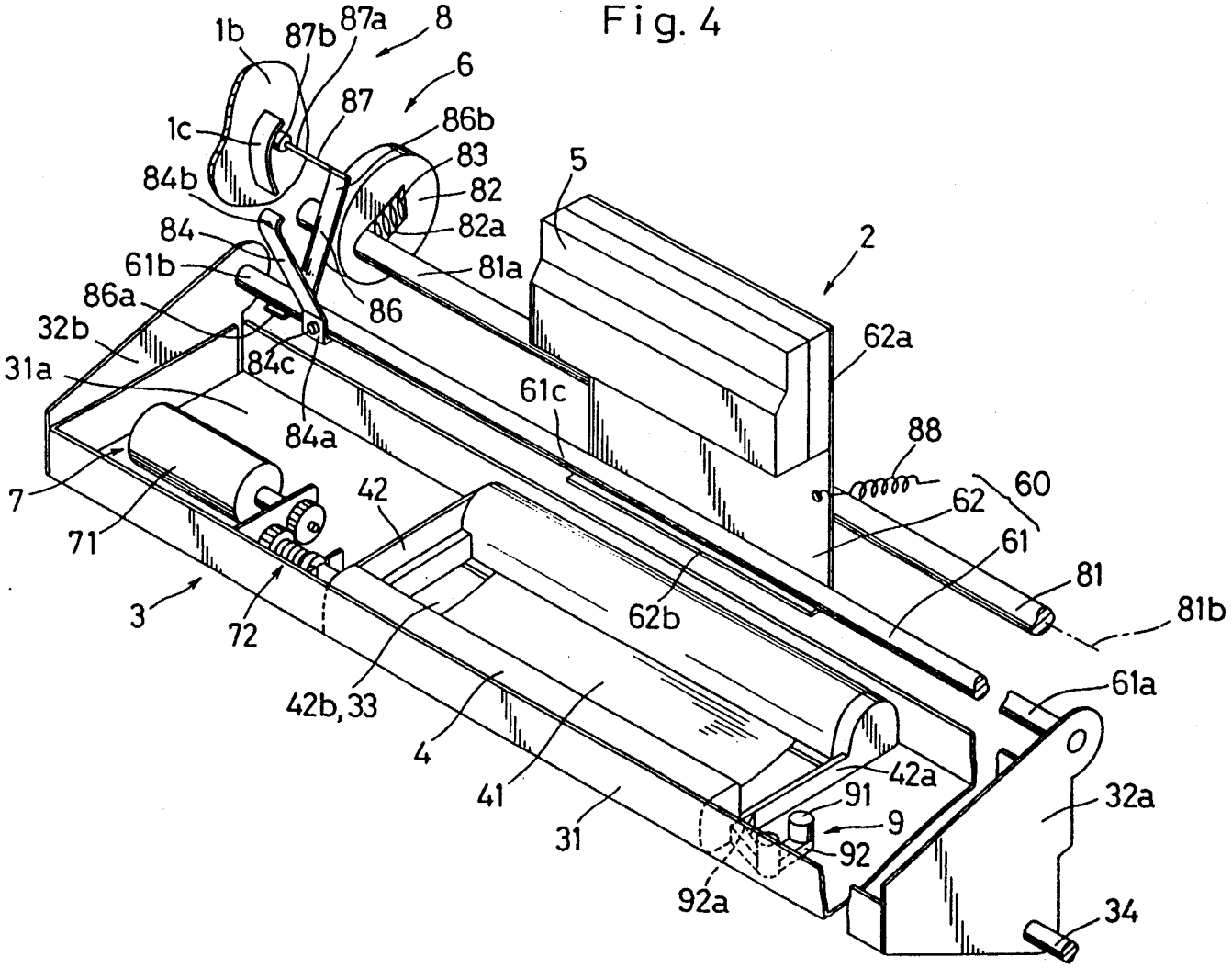
FIG. 4 is a perspective view showing the main portion of a thermal transfer printer including an interlocking mechanism.

Referring to FIG. 2 and FIG. 4, the thermal transfer printer 2 includes a casing 3, a cassette 4, a thermal head 5, a thermal head supporting means 60, a thermal head moving means 6, an ink-ribbon drive mechanism 7, an interlocking mechanism 8 and a lock means 9.

The casing 3 is pivotably supported by a pair of frame side plates 1*b*,1*d* (of which only lb is shown in FIG. 4) of the main body 1 of the copying machine by means of a pair of casing supporting shafts 34 (only one of which is shown). The casing 3 comprises a box 31 with its upper side open and a pair of nearly triangular side plates 32*a*, 32*b* respectively fastened to both end sides of the box 31.

The casing supporting shafts 34 are respectively fixed to the lower end portions of the side plates 32*a*, 32*b*, and are pivotably attached to the frame side plates 1*b*, 1*d*. The casing supporting shafts 34 may be attached directly to the frame side plates 1*b*, 1*d*, or may be attached indirectly by means of stays and the like. The casing 3 is pivotable on the casing supporting shaft 34 moving between a set position (refer to FIG. 18) and a retracted position (refer to FIG. 2) to allow the cassette 4 to be removed through the opening portion 20.

The cassette 4, which is detachably mounted in the casing 3, includes an ink-ribbon 41 in the form of a belt. The cassette 4 comprises the ink-ribbon 41, a body 42, a feed reel 43 and a winding reel 44 The feed reel 43 and the winding reel 44 are attached in parallel in the body 42. In the cassette 4, the ink-ribbon 41 fed from the feed reel 43 is wound on the winding reel 44. The portion of the ink-ribbon 41 which runs between the feed reel 43 and the winding reel 44 comprises a thermal transfer portion 41*a* to be used for thermal transferring.

Figure 8:
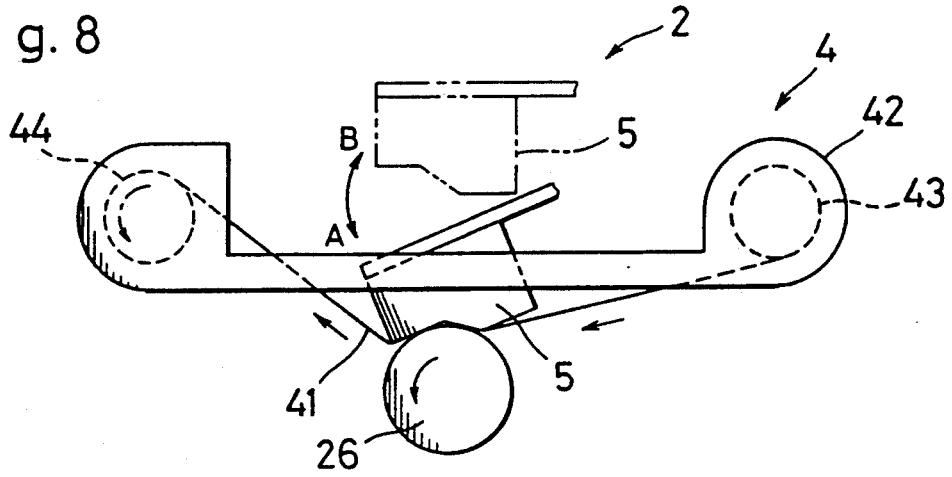
FIG. 8 is a schematic side view showing a thermal transfer printer during thermal transfer.

The body 42 of the cassette 4 has an opening 42*b* under the thermal transfer portion 41*a* of the ink-ribbon 41. In the bottom 31*a* of the box 31 of the casing 3, there is formed an opening 33 communicating with opening 42*b*. The thermal head 5 advances to extend the thermal transfer portion 41*a* of the ink-ribbon 41 downward from the cassette 4 and the casing 3 through the opening 42*b* (see FIG. 8 and FIG. 19). The thermal head advancing downward enables the thermal transfer portion 41*a* of the ribbon to touch a paper on a platen roller 26.

The ink-ribbon 41 is a ribbon for thermal transferring with heat meltable ink thereon. The ink-ribbon 41 is provided with a silver evaporation portion for light reflection, as will be described later. The ink-ribbon 41 before use is wound on the feed reel 43 with its leading edge connected to the core (not shown) of the winding reel 44. As the ink-ribbon 41 is used, the winding reel 44 turns to gradually wind the ribbon 41 fed from the feed reel 43 onto the winding reel 44.

By means of a mounting member 62, the thermal head 5 is supported on a thermal head supporting shaft 61 pivotably mounted in the casing 3. The thermal head supporting means 60 comprises the thermal head supporting shaft 61 and the mounting member 62. The thermal head 5 selectively supplies electricity to a plurality of minuscule resistors so as to cause them to generate heat, thereby to form a thermal transfer pattern on the paper.

Both ends 61*a*, 61*b* of the thermal head supporting shaft 61 are respectively fixed to side plates 32*a*, 32*b*. The mounting member 62 is comprised of a plate and has the thermal head 5 fixed on the upper portion 62*a* thereof. The lower portion 62*b* of the mounting member 62 is secured to the center portion 61*c* of the thermal head supporting shaft 61. The thermal head 5 is pivotable on the thermal head supporting shaft 62 between a pressing position (see FIG. 19) to press the ink-ribbon 41 to the paper and a retracted position (see FIG. 2) to allow the cassette 4 to be removed from the casing 3.

Figure 5:
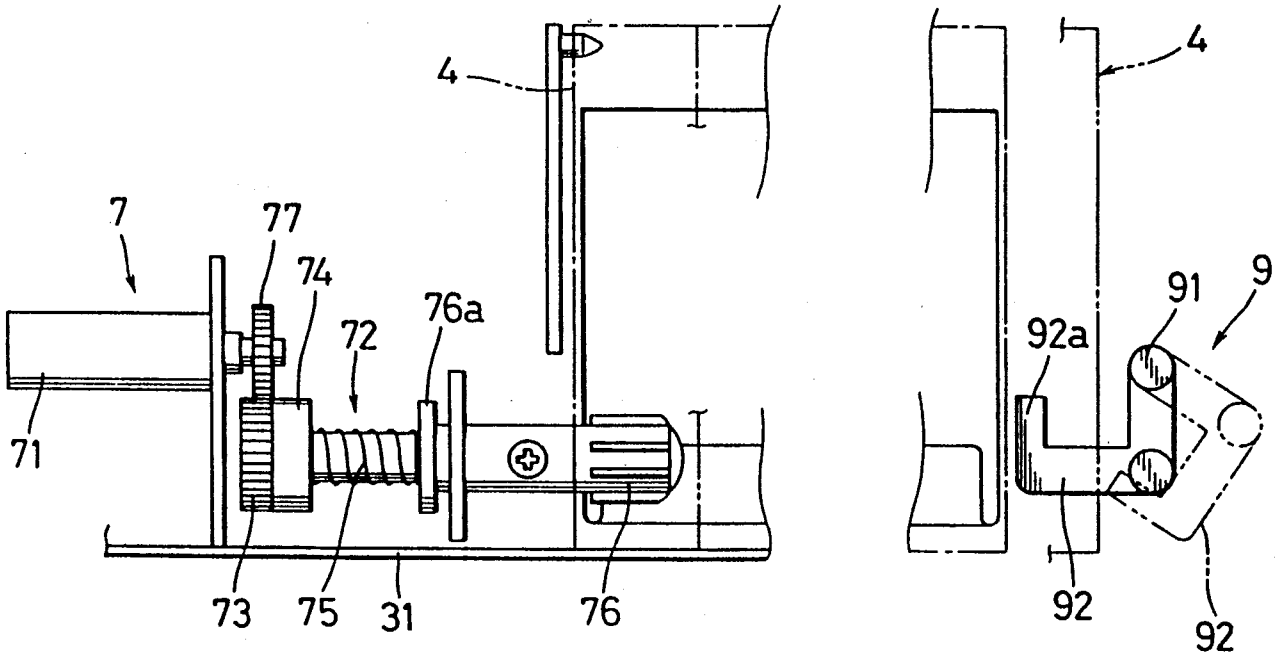
FIG. 5 is a schematic plan view illustrating the operation of replacing cassettes.

The lock means 9 is disposed inside of the box 31 of the casing 3 and retains the cassette 4 mounted in the casing 3. As shown in FIG. 4 and FIG. 5, the lock means 9 has a stopper 92 shaped like a reversed letter 'L', which is pivotable on a shaft 91 fixed to the bottom 31*a* of the box 31 of the casing 3. By bringing the end portion 92*a* of the stopper 92 into contact with bringing the end portion 42*a* of the body 42 of the cassette 4, the lock means 9 retains the cassette 4 in a predetermined position in the casing 3, thus preventing the cassette 4 from falling from the casing 3.

The removal of the cassette 4 from the casing 3 is performed as follows with reference to FIG. 5. The stopper 92 is turned counterclockwise to the position shown in the two-dots-dash line in FIG. 5, on the right of the cassette 4. Then the cassette 4 is slid rightward from the place shown in the dot-dash line to the place shown in the two-dot-dash line in FIG. 5. A connecting shaft 76 and the winding reel 44 are disengaged so that the cassette 4 may be taken up out of the casing 3. The cassette 4 may be mounted in the casing 3 by the reverse order of the steps of the above removal operations.

INTERLOCKING MECHANISM

The interlocking mechanism 8 moves thermal head 5 to its retracted position when casing 3 moves to its retracted position. Referring to FIG. 4, the interlocking mechanism 8 comprises a stay 86, a mounting shaft 87, a guided roller 87*b*, a guiding member 1*c* and a tension spring 88.

The stay 86 comprises a plate spring which is attached to end portion 61*b* of thermal head supporting shaft 61 and is integrally pivotable with shaft 61 and extends substantially radially from shaft 61. The mounting shaft 87 is fastened to an end 86*b* of the stay 86, extending in parallel to the thermal head supporting shaft 61. The guided roller 87*b* comprises a roller pivotably attached to an end 87*a* of the mounting shaft 87. The guiding member 1*c* is a concave plate fastened to frame side plate 1*b* of the main body 1 of the copying machine. The tension spring 88 is disposed between mounting member 62 and a casing 17*a* of a fixing device 17 (FIG. 2), biasing the mounting member 62 toward the casing 17*a*.

A description will be given as to the operations of the interlocking mechanism 8. The punching unit 18 and the cover 1*i* in the position shown in FIG. 18 are pivoted on shaft 18*b* counterclockwise relative to the main body 1 of the copying machine, and thus opening portion 20 is opened in the side 1*a* of the main body 1 of the copying machine (see FIG. 2 and FIG. 3). Then the casing 3 of the thermal transfer printer 2, which is set in a set position (see FIG. 18), is pivoted counterclockwise on casing supporting shaft 34 in FIG. 18, thereby to move the casing 3 to its retracted position (see FIG. 2). When the casing 3 pivots to its retracted position, referring to FIG. 2 and FIG. 4 the thermal head supporting shaft 61 attached to the casing 3 pivots counterclockwise about the casing supporting shaft 34 in FIG. 2. At this time, the guided roller 87*b* is engaged with the guiding member 1*c* and moves upward along the guiding member 1*c*. The thermal head supporting shaft 61 then pivots clockwise in FIG. 2. Thus, the thermal head 5 supported by the thermal head supporting shaft 61 pivots clockwise in FIG. 2, thereby to move to the retracted position shown in FIG. 2.

The tensile force of the tension spring 88, which is engaged with the mounting member 62, facilitates movement of the thermal head 5 to its retracted position and ensures that the thermal head 5 stays at that position. Accordingly, a used cassette 4 can be easily replaced with a new one through the opening portion 20 formed in the side la of the m in body 1 of the copying machine, and in addition, any paper jam that occurs in the periphery of the thermal transfer printer 2 can be easily cleared.

Unlike a conventional copying machine wherein the casing 3 is moved in the axial direction of the platen roller 26 by a hand inserted through a narrow throughhole in the frame side plate 1*b* or 1*d*, the cassette 4 is removed through the large opening portion 20 in the side face 1*a* of the main body 1 of the copying machine. Accordingly, the cassette 4 can be replaced more easily. Furthermore, a new cassette 4 can be mounted without inflicting any damage on the ink-ribbon of the new cassette 4.

The interlocking mechanism 8 retracts the thermal head 5, making effective use of the space above the thermal transfer printer 2. Hence, the main body 1 of the copying machine need not be made large but still facilitates the replacement of the cassette 4 or clearing of a paper jam.

Figure 24:
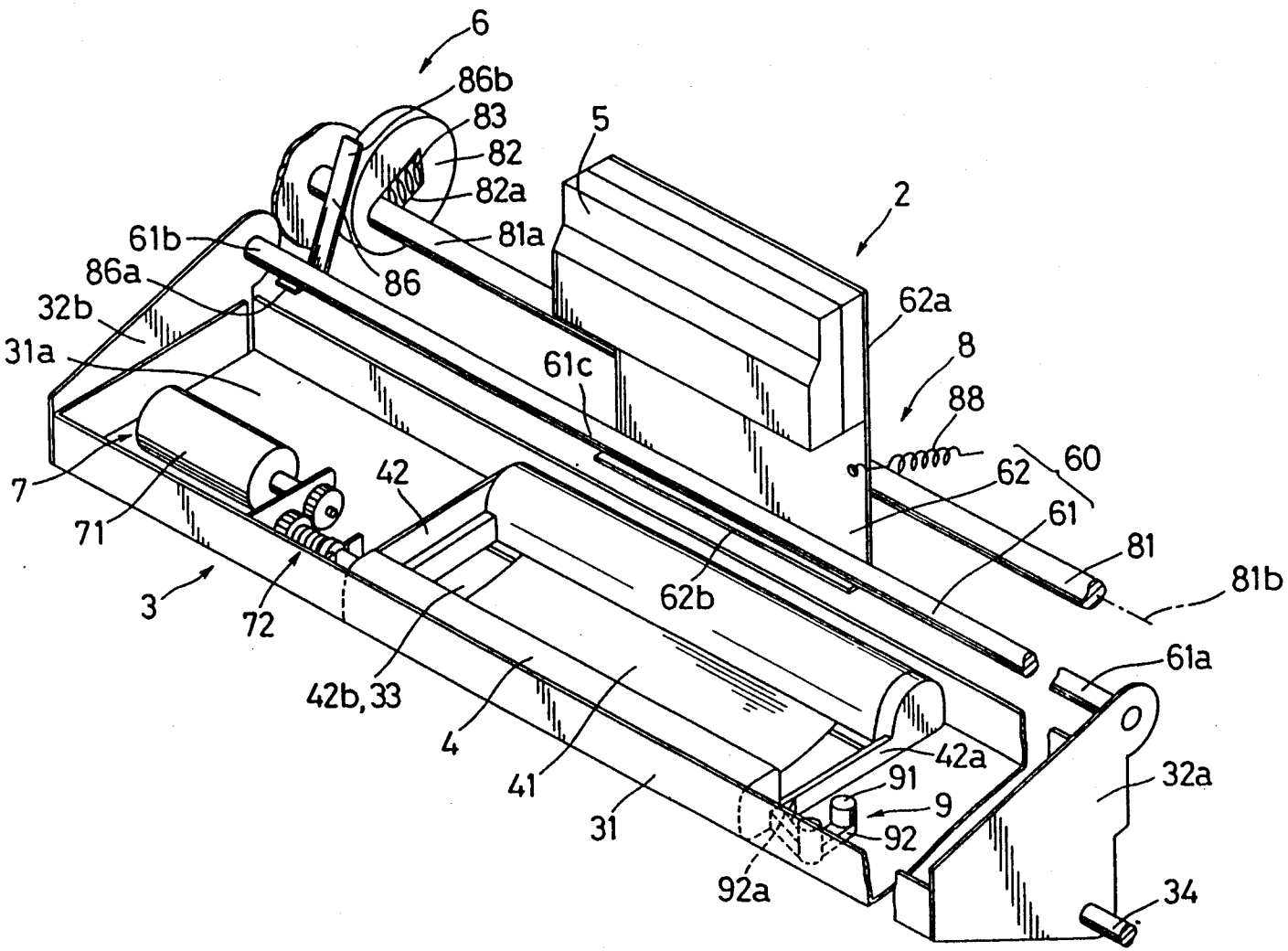
FIG. 24 is a perspective view showing another interlocking mechanism.

The interlocking mechanism 8 may comprise a stay 86, a mounting shaft 87, a guided roller 87*b* and a guide member 1*c*. The interlocking mechanism may also consist of a tension spring 88 as shown in FIG. 24.

The interlocking mechanism 8 may comprise a turning transmission mechanism such as a gear setup.

The interlocking mechanism 8 may further comprise a stepper motor for driving the thermal head supporting shaft 61, a movement detection means for detecting retraction of casing 3 to its retracted position, and a control means for having the stepper motor drive the thermal head supporting shaft 61 according to a signal from the movement detection means, thereby to move the thermal head to its retracted position. A torsion bar engaged with the thermal head supporting shaft 61 may be used in place of the tension spring 88.

THERMAL HEAD MOVING MEANS

The thermal head moving means 6 selectively moves the thermal head either to a pressuring position (shown in FIG. 19) in which the thermal head 5 presses the ink-ribbon 41 to platen roller 26, or to a pressure release position (shown in FIG. 18) in which the thermal head 5 releases pressure from the ink-ribbon 41 after turning for a predetermined length from the pressuring position to the retracted position. This is to prevent rapid deterioration of the ink-ribbon 41 which may occur when the ink-ribbon 41 is close to the passage through which passes paper which has been heated to relatively high temperatures by fixing devices 17. That is, when thermal transferring is not performed, the thermal head moving means 6 moves the thermal head 5 to its pressure release position so as to retract the thermal head 5, thereby to keep the ink-ribbon 41 away from the hot passage to prevent deterioration of the ink-ribbon 41.

Referring to FIG. 4, the thermal head moving means 6 comprises a roller supporting shaft 81, an eccentric roller 82 which comprises a turning means, a compression coil spring 83, the stay 86, and a plate spring 84.

Both ends of the roller supporting shaft 81 are supported directly or indirectly by the frame side plates 1*b*, 1*d* of the main body 1 of the copying machine. The eccentric roller 82 has a long shaft-inserting through hole 82*a* in extending the radial direction thereof. In this shaft-inserting through hole 82*a*, an end portion 81*a* of roller supporting shaft 81 is inserted and is movable in the radial direction. The compression coil spring 83 is also disposed in the shaft-inserting through hole 82*a*. The pressure of the compression coil spring 83 keeps the center of the eccentric roller 82 away from the axial line 81*b* of the roller supporting shaft 81. Due to this, the eccentric roller 82 eccentrically turns with turning of the roller supporting shaft 81.

The plate spring 84 has an end portion 84*a* thereof fastened with a screw 84*c* to the end portion 61*b* of the thermal head supporting shaft 61, thus pivoting with the thermal head supporting shaft 61. The other end portion 84*b* of the plate spring 84 extends substantially radially from the thermal head supporting shaft 61. This end portion 84*b* presses against the bottom 31*a* of box 31 of the casing 3 when the casing 3 is in a set position, as depicted in FIG. 19.

Description will be given of the operation of the thermal head moving means 6. When the mode to perform thermal transferring is not selected in the copying machine, the compression coil spring 83 is positioned on the upper right of the roller supporting shaft 81 as shown in FIG. 18, and no pressure is applied by the eccentric roller 82 to the plate spring 86 of the guiding member 85. Therefore in FIG. 18, the thermal head 5 is urged to pivot clockwise by the restitutive force of the plate spring 84 in FIG. 18 and thus is positioned in its pressure release position.

When a mode to perform thermal transferring is selected in the copying machine, the thermal head supporting shaft 61 is pivoted one-half a rotation. Then as shown in FIG. 19, the compression coil spring 83 is positioned on the opposite side of the roller supporting shaft 81. Due to this, the stay 86 is pressed by the eccentric roller 82, and the thermal head supporting shaft 61 is pivoted counterclockwise from the position shown in FIG. 18 against the restitutive force of the plate spring 84 against the bottom 31*a* of the box 31. Thus the thermal head 5 is pivoted counterclockwise from the pressure release position shown in FIG. 18 and moved to its pressuring position shown in FIG. 19.

Figure 19:
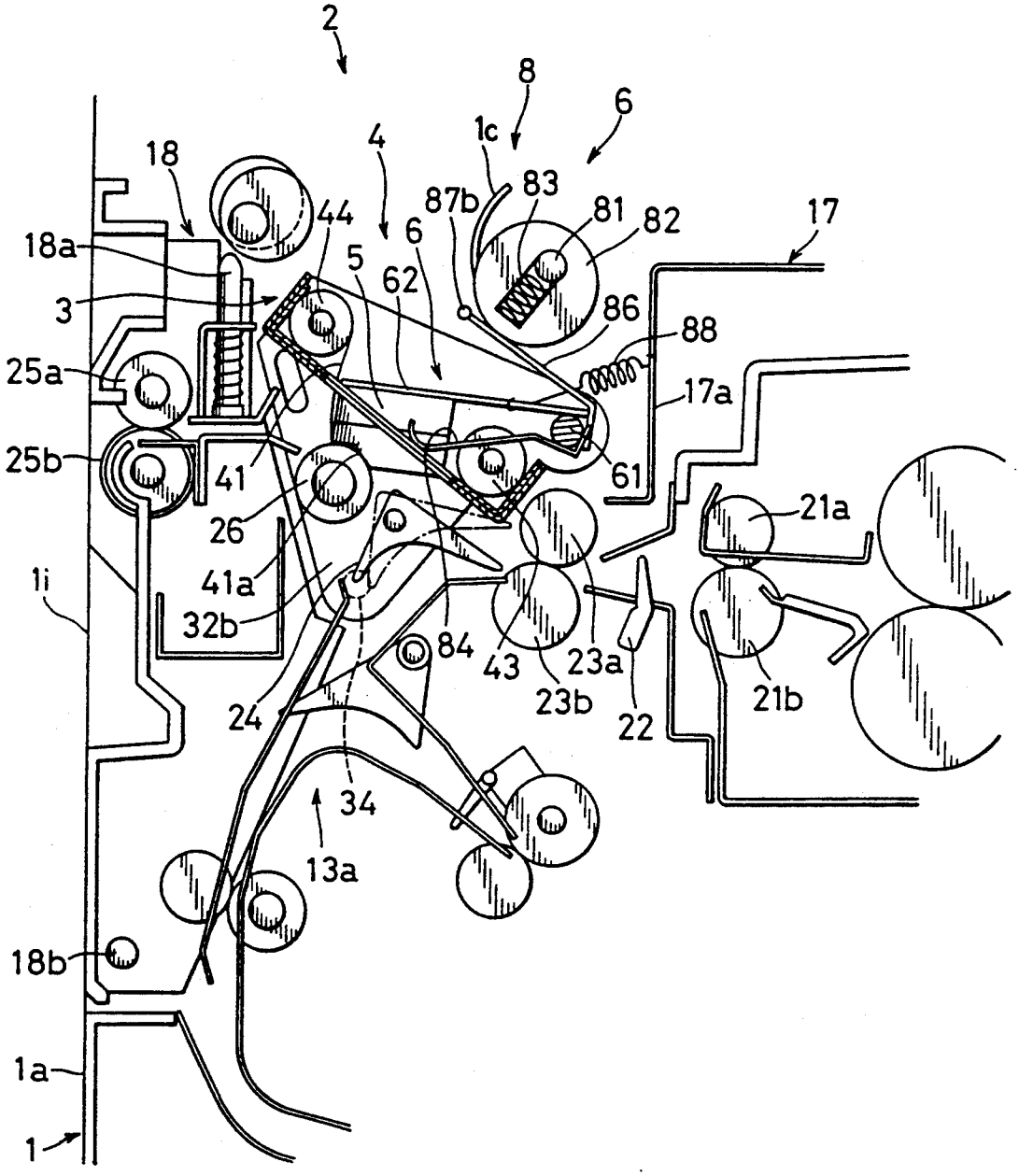
FIG. 19 is a schematic side view of a copying machine wherein a thermal head is in a pressure release position.

When the mode to perform thermal transferring is canceled again, the eccentric roller 82 releases pressure on the stay 86, and thus the thermal head supporting shaft 61 is pivoted clockwise from the pressuring position shown in FIG. 19 by the restitutive force of the plate spring 84, thereby to move the thermal head 5 to the pressure release position of the thermal head 5.

The thermal head supporting shaft 61 may be attached to the frame side plates 1*b*, 1*d* of the main body 1 of the copying machine.

PAPER DELIVERY PORTION

At the outlet of the fixing device 17, there are disposed discharge rollers 21*a*, 21*b* for discharging paper with toner image formed thereon from the fixing device 17, and a fusing completion detection switch 22 is disposed on the downstream side of the discharge rollers 21*a*, 21*b* in the paper delivery direction. As the leading edge of the paper is discharged from the discharge rollers 21*a*, 21*b*, the detection switch 22 in the position shown in a solid line pivots down to the position shown in dot-dash line in FIG. 18, thus being turned on. The moment the trailing edge of the paper has passed the detection switch 22, the detection switch 22 returns to the position shown in solid line, being turned off. That is, the leading edge of the paper having passed the detection switch can be detected by sensing the edge of the detection switch 22 as it is switched from off to on, and the trailing edge of the paper having passed can be detected by sensing the edge of the detection switch 22 as it is switched from on to off.

The paper discharged from the discharge rollers 21*a*, 21*b* is sent by delivery rollers 23*a*, 23*b* to the downstream side of the paper delivery portion. On the downstream side of the paper delivery portion, there is disposed a switching claw 24 in the vicinity of the delivery rollers 23*a*, 23*b*. The switching claw 24, when in the position shown with a solid line in FIG. 18, guides the paper to discharge rollers 25*a*, 25*b*, and when in the position shown with a dot-dash line, guides the paper to a paper refeed passage 13*a*.

According to a signal from the detection switch 22, the discharge rollers 25*a*, 25*b* and the platen roller 26 to which the paper is passed, slow down delivery of the paper to a speed slow enough for the thermal transfer printer 2 to perform thermal transferring. The delivery rollers 23*a*, 23*b*, the discharge rollers 25*a*, 25*b* and the platen roller 26 are driven by a common stepper motor (not shown), whose rotating speed is adapted for change.

INK-RIBBON DRIVE MECHANISM

Figure 6:
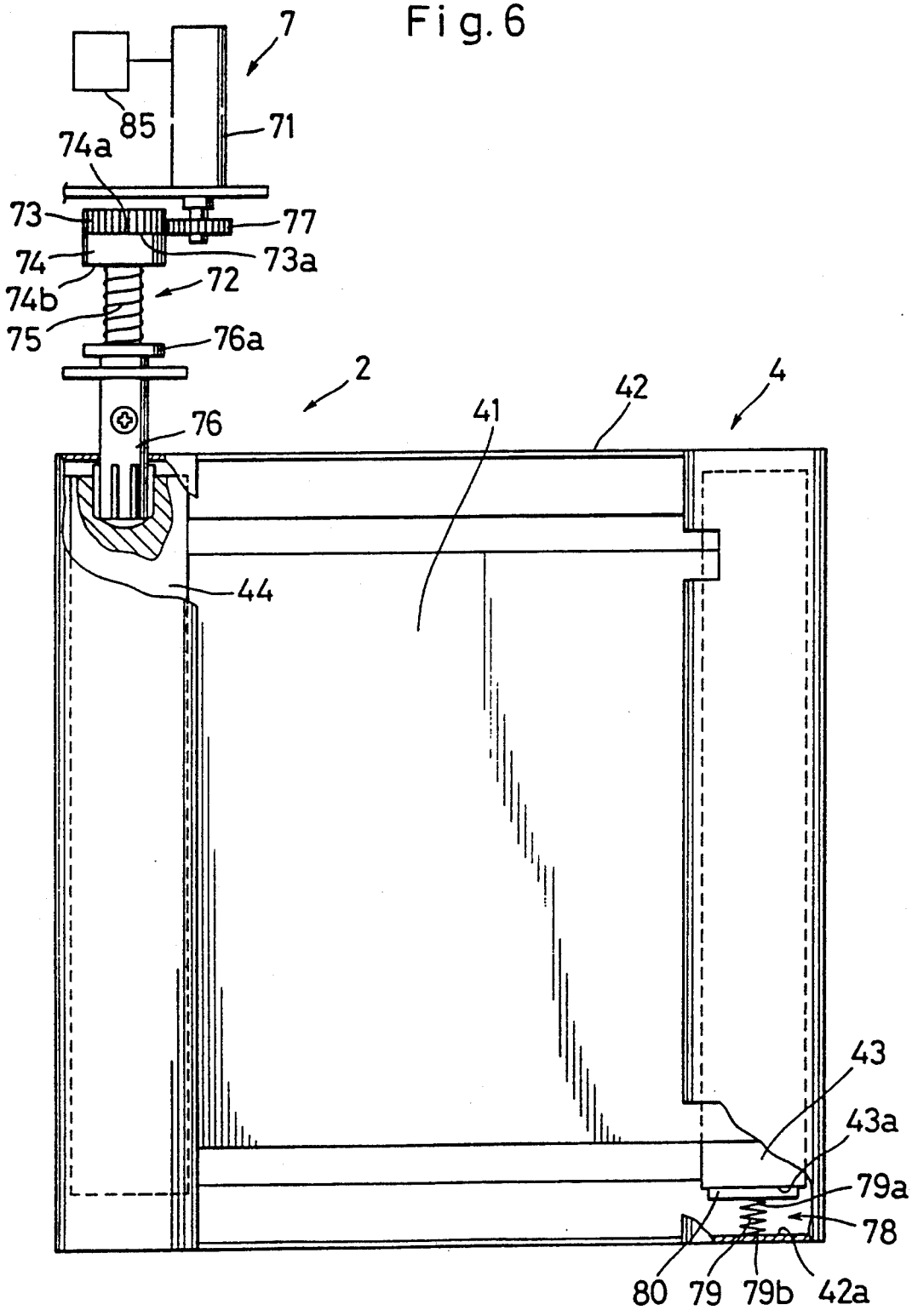
FIG. 6 is a plan view with portions broken away to reveal the drive means for an ink-ribbon.
Figure 7:
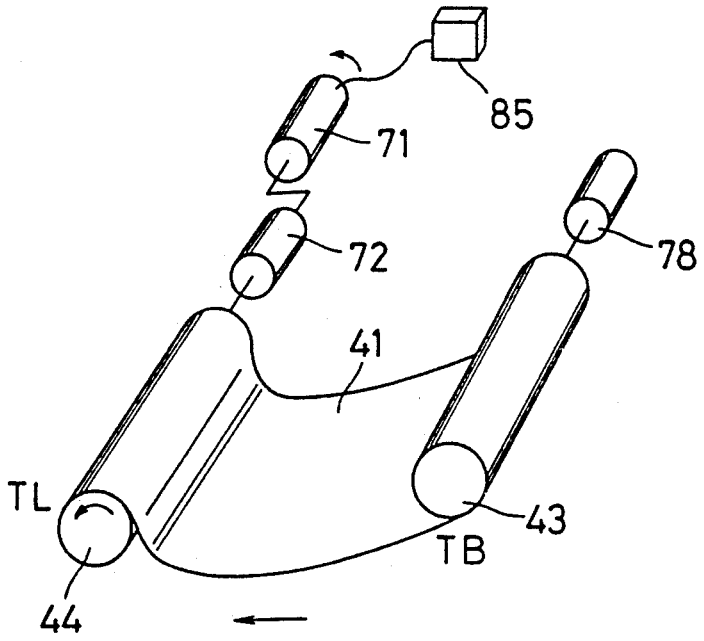
FIG. 7 is a schematic perspective view of the drive mechanism for an ink-ribbon.

Referring to FIGS. 6 and 7, the ink-ribbon drive mechanism 7 includes a winding reel drive motor 71 as a ribbon slack eliminating means, a torque limiter 72, resistance loading means 78, and winding control means 85.

The motor 71 drives the winding reel 44 so as to have the winding reel 44 wind the ink-ribbon 41 thereon.

The torque limiter 72 intervenes between the winding reel 44 and the winding reel drive means 71, limiting drive torque from the winding reel drive means 71 to the winding reel 44 to less than a predetermined torque. The torque limiter 72 includes a first member 73, a second member 74 and an urging means 75.

The first member 73 comprises a gear attached to an end of a connecting shaft 76, being relatively rotatable on the connecting shaft 76. The connecting shaft 76 is connected to the winding reel 44, being integrally rotatable with the winding reel 44. The first member 73 is engaged with a gear 77 integrally rotatable with a motor 71. The second member 74 comprises a ring combined with the connecting shaft 76 through a spline. The second member 74 is integrally rotatable with the connecting shaft 76 and is movable in the axial direction of the connecting shaft 76. The end 73*a* of the first member 73 and the end 74*a* of the second member 74 are in contact with each other. The urging means 75, which intervenes between the flange portion 76*a* provided midway on the connecting shaft 76 and the end 74*b* of the second member 74, comprises a compression coil for pressing the end 74*a* of the second member 74 to the end 73*a* of the first member 73.

When driven by the motor 71, the gear 77 drives the first member 73. Meanwhile, the first member 73 and the second member 74 are connected together by means of frictional force, through which drive torque is transmitted from the first member 73 to the second member 74. Due to this, the connecting shaft 76 is actuated to drive the winding reel 44. When the drive torque becomes greater than the torque transmittable by the frictional force, the end 73*a* of the first member 73 slips on the end 74*a* of the second member 74, thus relatively rotating. Hence, the drive torque transmitted from the motor 71 to the winding reel 44 is limited.

The transmittable torque can be set to a desired value by adjusting the roughness of the end 73*a* and the end 74*a* and the strength of the pressing force of the urging means 75. In this manner, transmission of drive torque equal to or greater than a predetermined torque TL can be prevented. This enables avoiding a predetermined value or more of tensile force on the ink-ribbon 41 wound on the winding reel 44.

The resistance loading means 78 comprises a compression coil 79, an end portion 79*a* of which is fastened on the inside 42*a* of the body 42 of the cassette 4, and a frictional member 80 which is fastened to the other end portion 79*b* of the compression coil 79 and which is urged by the compression coil 79 against the end 43*a* of the feed reel 43. The resistance loading means 78 generates braking torque TB to regulate the rotation of the feed reel 43 by means of the frictional force between the end 43*a* of the feed reel 43 and the frictional member 80. The predetermined torque TL of the torque limiter 72 is set less than the braking torque TB of the resistance loading means 78. Alternatively, the resistance loading means 78 may be provided outside of the cassette 4.

Figure 9:
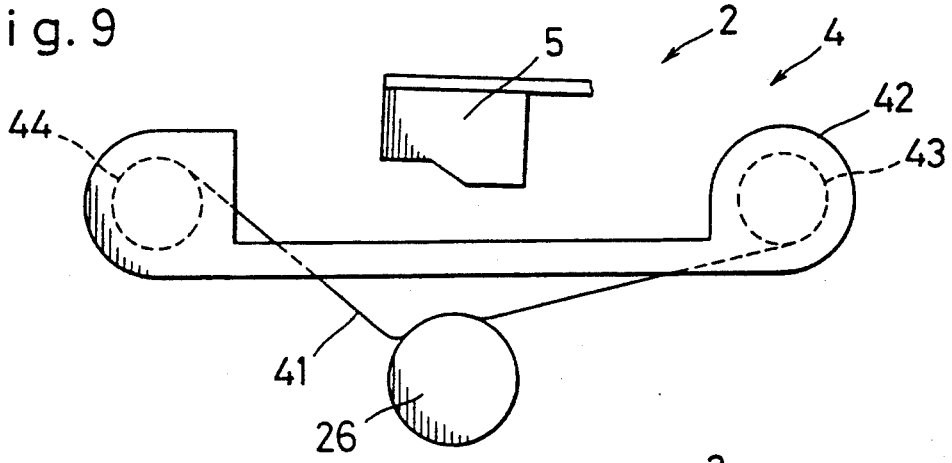
FIG. 9 is a schematic view showing a thermal transfer printer directly after completion of thermal transfer.
Figure 10:
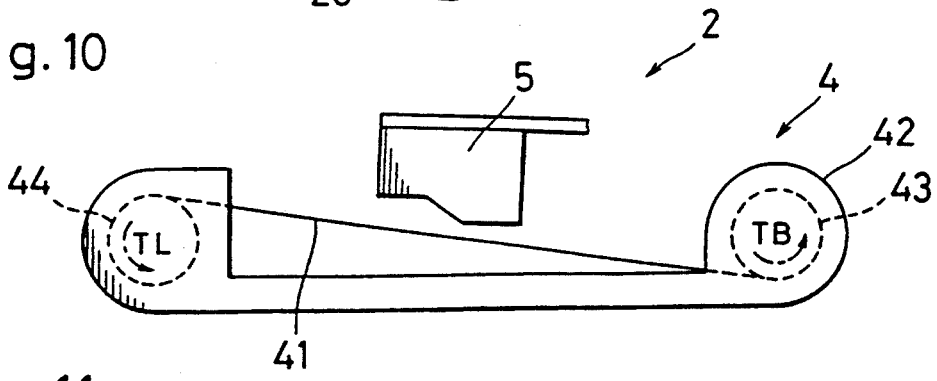
FIG. 10 is a schematic side view showing a thermal transfer printer wherein a slackened ink-ribbon is wound up after completion of thermal transfer.

The following description will discuss the operation eliminating the ribbon slack by means of the motor 71, torque limiter 72, and resistance loading means 78. On completion of thermal transferring in a state shown in FIG. 8, the thermal head 5 retracts as shown in FIG. 9. Retraction of the thermal head 5 results in slack in the ink-ribbon 41. As shown in FIG. 10, when the motor 71 drives the winding reel 44 to wind slackened ribbon 41 thereon, this eliminates the slack in the ink-ribbon 41 and places the ink-ribbon 41 between the feed reel 43 and the winding reel 44 in tension.

At this time, the braking torque TB of the resistance loading means 78 is applied to the winding reel 44 through the feed reel 43 and the ink-ribbon 41. Transmission of a predetermined value TL or more of the drive torque to the winding reel 43 is checked by the torque limiter 72, and the braking torque T is greater than the predetermined value TL. Accordingly, unused ink-ribbon 41 is not drawn out from the feed reel 43 to be fed to the winding reel 44, thereby ensuring the elimination of ribbon slack between the feed reel 43 and the winding reel 44.

Then, the motor 71 stops and applies no load on the ink-ribbon 41 between the feed reel 43 and the winding reel 44. Therefore, the ink-ribbon 41 does not suffer deterioration of durability due to unnecessary tensile load thereon.

Figure 11:
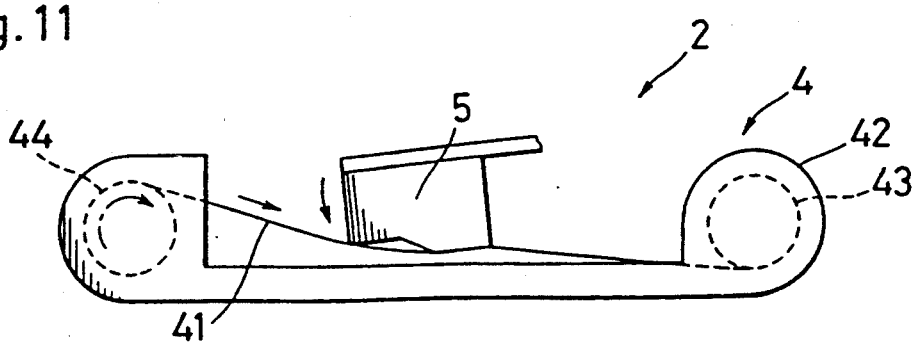
FIG. 11 is a schematic side view showing a thermal transfer printer ready to perform thermal transfer.

Referring to FIG. 11, when the thermal head 5 extends the ink-ribbon 41 downward between the feed reel 43 and the winding reel 44 for thermal transferring, the unused portion of the ink-ribbon 41 wound on the feed reel 43 is not wastefully fed to the winding reel 44, which is economical. This is because the braking torque TB on the feed reel 43 is greater than the predetermined value TL set by the torque limiter 72, the portion of the ink-ribbon 41 wound on the winding reel 44 in eliminating the ribbon slack is drawn out from the winding reel 44 and the ink-ribbon 41 is returned to the state when thermal transferring is completed.

In a conventional example wherein a tension spring winds an ink-ribbon on a feed reel, if a torque limiter is connected with a winding reel while the tensile force of the tension spring is greater than a predetermined torque set by the limiter, thermal transferring fails at times. In the conventional example, the portion of the ink-ribbon that has been used for thermal transferring and wound on the winding reel is wound back to the feed reel to be fed again for thermal transferring, thus resulting in failure of thermal transferring. On the other hand, the embodiment of the present invention wherein the tensile spring is not employed does not present such a problem.

Because during thermal transferring the feeding force which the platen roller 26 applies to the ink-ribbon 41 via the paper is greater than the frictional braking torque TB loaded on the feed reel 43, the ink-ribbon 41 is fed from the feed reel 43. The ink-ribbon 41 which passed the thermal head 5 and was used for thermal transferring is wound on the winding reel 44.

Figure 17:
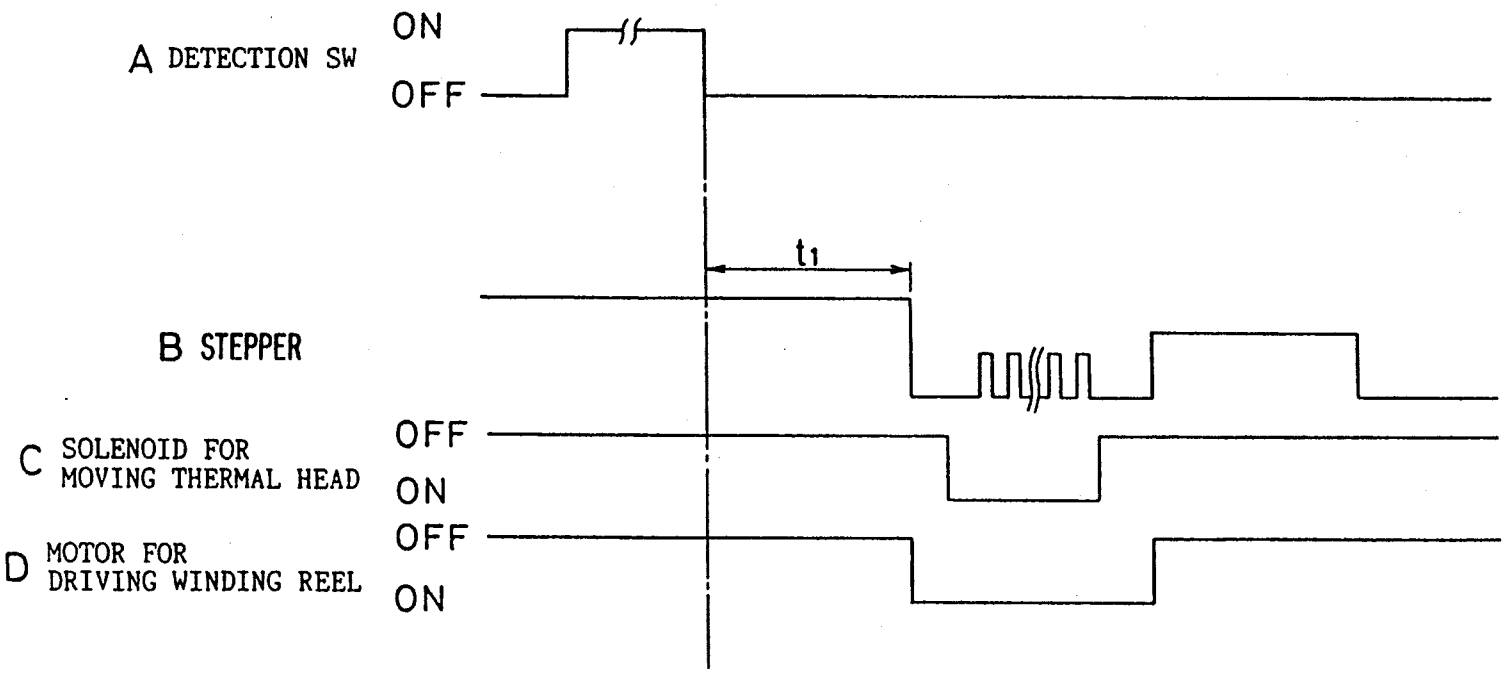
FIG. 17 is a timing chart for the operation of a thermal transfer printer.

Referring to FIGS. 17 to 19, the control operations of thermal transfer printer 2 will be described.

When a mode for the thermal transfer printer 2 to perform thermal transferring is not selected, paper discharged from a fixing device 17 is delivered at paper discharge speed by delivery rollers 23*a*, 23*b* and discharge rollers 25*a*, 25*b* to be discharged on a discharge tray 19 (FIG. 19). In this case, the stepper motor moving the platen roller 26 is rotated at 300 mm/sec.

When a mode for the thermal transfer printer 2 to perform thermal transferring is selected, the rotational speed of the stepper motor is changed as described as follows.

When paper is discharged from fixing device 17 and the trailing edge of the paper has passed fusion completion detection switch 22, the detection switch 22 is switched from on to off as shown in FIG. 17. Using the detection of the trailing edge of the paper by the detection switch 22 as reference, the thermal transfer printer 2 is operated after a predetermined period of time, thereby to enter additional information at a place a predetermined length from the trailing edge of the paper.

When a mode for the thermal transfer printer to perform thermal transferring is selected, the stepper motor is stopped at a time $t_1$ after the trailing edge of the paper is detected by the fusing completion switch 22, as shown in FIG. 17. At this time, the trailing edge of the paper stops on the upstream side, 20 mm for instance, in the delivery direction from the platen roller 26. After the stepper motor is stopped, a solenoid (not shown) for extending and retracting the thermal head 5 is turned on to pivot eccentric roller 82 on roller supporting shaft 81 by one-half revolution, thus lowering the thermal head 5 to the pressing position shown in FIG. 19.

While holding the thermal head 5 in this position, the stepper motor is intermittently driven step by step, for 80 steps for instance. Each time the stepper motor is stopped, the thermal head 5 enters additional information line by line on the paper (see FIG. 17-B).

In this way, the additional information is entered on the trailing portion of the paper, or entered after the entire paper is discharged from fixing device 17. Therefore, there is no possibility that a part of the paper is deformed or burnt due to the heat of the fixing device 17.

When the stepper motor has been operated for 80 steps and entering of additional information has been completed, the stepper motor is stopped for a moment. Then power to the solenoid is cut off, and hence the thermal head 5 is retracted to its pressure release position by the restitutive force of plate spring 84.

Corresponding to stepper motor turning off, the drive motor 71 for the winding reel 44 is turned on (see FIG. 17-D), and the ink-ribbon 41 drawn out for thermal transferring is wound on the winding reel 44. Accordingly, the ink-ribbon 41 is free from sticking to the paper or generating unnecessary slack therein.

PAPER COOLING MECHANISM

Figure 20:
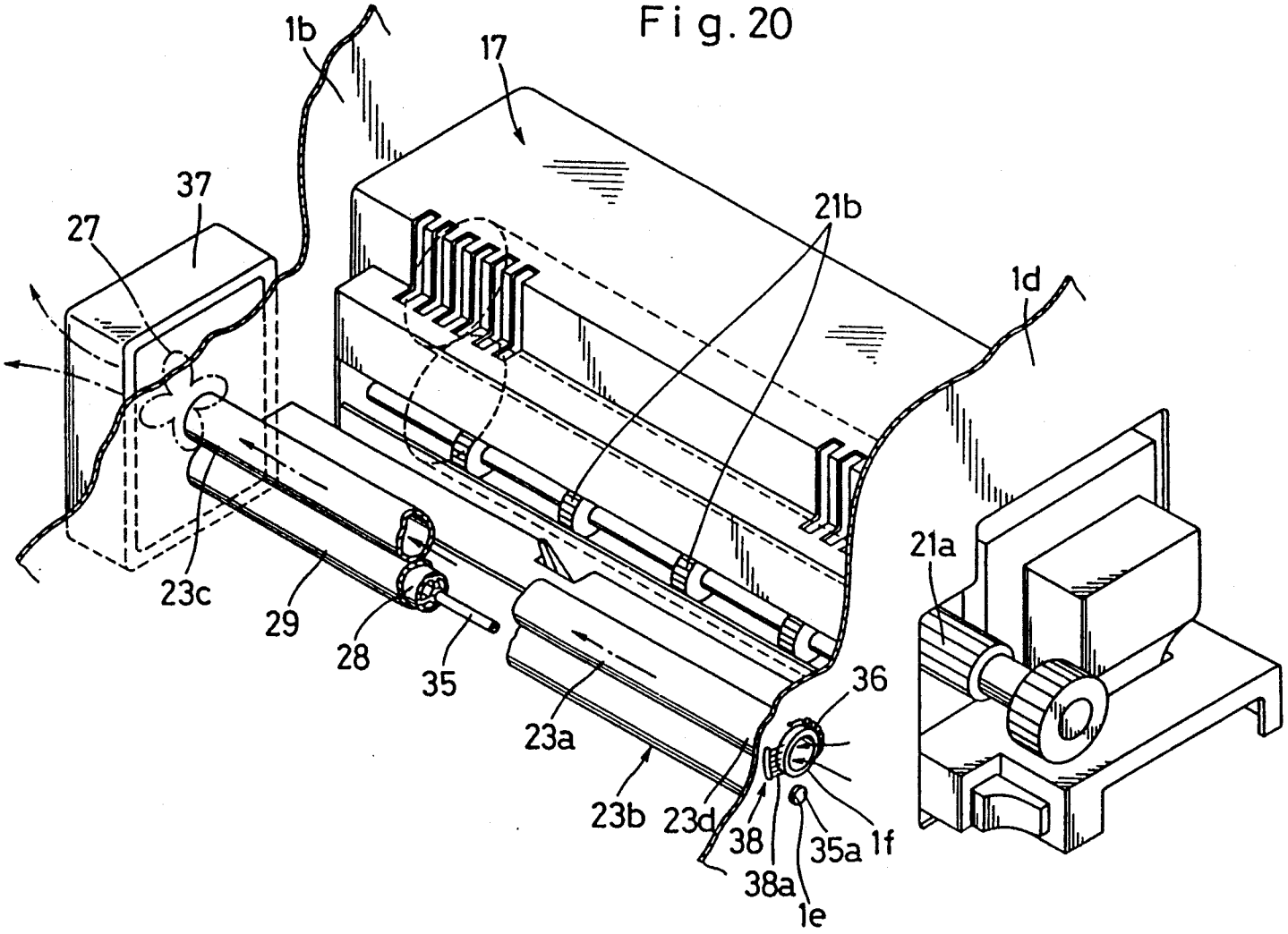
FIG. 20 is a schematic perspective view showing the periphery of a fixing device in a copying machine.
Figure 21:
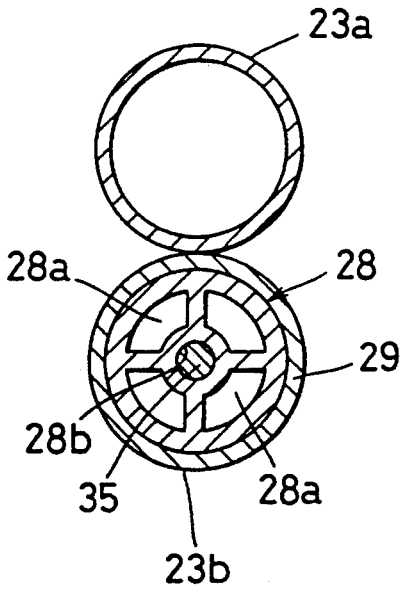
FIG. 21 is a sectional view of a pressuring roller and a pipe.

Referring to FIG. 20 and FIG. 21, the paper cooling mechanism 10 allows air to flow inside either of the delivery rollers 23*a*, 23*b* disposed near the outlet of the fixing device 17 and cools the delivery roller 23*a*, 23*b*, *thereby to cool the paper.*

The paper cooling mechanism 10 comprises the delivery rollers 23*a*, 23*b*, a means for driving these delivery rollers 23*a*, 23*b*, and an intake fan 27 for causing air to flow inside of the delivery roller 23*b*.

The delivery roller 23*a* comprises an aluminum roller bridged across the pair of the frame side plates 1*b*, 1*d*. The delivery roller 23*b* is a roller for pressing the paper discharged from the discharge rollers 17*a*, 17*b* of the fixing device 17 on the circumference of the delivery roller 23*a* over the full width thereof. The delivery roller 23*b* is driven in synch with the paper delivery portion 13 by means of a drive system of the copying machine, not shown in the figure. The delivery roller 23*a* is driven by the delivery roller 23*b*, and the delivery roller 23*b* along with the delivery roller 23*a* jointly convey the paper to a passage in the thermal transfer printer 2. The delivery roller 23*a* may be driven by the delivery roller 23*b* through the paper or through a chain or the like.

As shown in FIG. 21, the delivery roller 23*b* comprises an aluminum supporter 28 formed with a plurality of hollow portions 28*a* extending in the axial direction of the roller and a frictional member 29 made of rubber or the like which is provided on the circumference of the supporter 28. A supporting shaft 35 is pressed into a shaft-inserting through hole 28*b* provided in the center portion of the supporter 28. End portions 35*a* of the supporting shaft 35 are inserted in through holes 1*e* provided respectively in the frame side plates 1*b*, 1*d*, so that the supporting shaft 35 is rotatably supported by the frame side plates 1*b*, 1*d*.

End portions 23*c*, 23*d* of the delivery roller 23*a* go through inserting through-holes 1*f* provided respectively in the frame side plates 1*b*, 1*d*. The end portion 23*c* communicates outside of the frame side plate 1*b* with intake fan 27. The end portion 23*d* is directly open to the outside of the frame side plate 1*d*. The inserting through holes 1*f* have a diameter slightly larger than that of the delivery roller 23*a*, so that the delivery roller 23*a* may be free to move in the radial direction. The end portions 23*c*, 23*d* of the delivery roller 23*a* are elastically biased toward the delivery roller 23*b* by a tension spring 36. Thus, the clearance between the delivery roller 23*b* and the delivery roller 23*a* is adjusted s as to correspond to the thickness of the paper passing through the clearance therebetween.

There is a static electricity removal means 38 attached on the frame side plate 1*d*. The static electricity removal means 38 discharges to the frame side plate 1*d* static electricity on the aluminum delivery roller 23*a* as that roller is touching the paper. The static electricity removal means 38 is electrically connected with the frame side plate 1*d* and has a plurality of brush contacts 38*a* which are brought in contact with the end portion 23*d* of the delivery roller 23*a*. That the static electricity removal means 38 discharges the static electricity in the delivery roller 23*a* prevents the ink-ribbon 41 from adhering to the paper.

The intake fan 27 is disposed inside of a box 37 attached to the outside of the frame side plate 1*b* and is actuated by a motor (not shown) to draw air from outside of the frame side plate 1*d* through the end portion 23*d* and into the inside of the delivery roller 23*a*. The air drawn into the delivery roller 23*a* flows from the end portion 23*c* through the box 37 to be exhausted outside of the frame side plate 1*b*.

The hot paper whereon the fixing device 17 has fused a toner image by heating is discharged by the discharge rollers 21*a*, 21*b* and is interposed between the delivery roller 23*b* and the delivery roller 23*a*. Then the paper is delivered to the thermal transfer printer 2 while being pressed to the circumference of the delivery roller 23*a* over the full width thereof.

During the conveying of the paper, the intake fan 27 draws relatively cool air from outside of the frame side plate 1*d* into the delivery roller 23*a*, thereby cooling the paper through the aluminum delivery roller 23*a*, which has good heat conductivity, before thermal transferring.

The paper can be effectively cooled partly because relatively cool air outside of the frame side plate 1*d* is drawn into the delivery roller 23*a* and partly because hot air which has absorbed heat from the delivery roller 23*a* is exhausted out of the frame side plate 1*b* and does not remain in the periphery of the delivery roller 23*a*. Due to this, failure of thermal transferring due to the hot paper melting ink in a portion other than the thermal transferring pattern to transfer the ink on the paper can be prevented.

Since the intake fan 27 does not dissipate heat from the fixing device 17, the heating efficiency of the fixing device 17 does not deteriorate.

The fan 27 may be replaced by a fan for blowing air into the delivery roller 23*a*. In addition to a fan disposed at either of the end portions 23*c*, 23*d* of the delivery roller 23*a*, a fan may be disposed at each end portion thereof, thus utilizing two fans to enhance the cooling efficiency even more.

Further, air may be allowed to flow inside of the supporter 28 of the delivery roller 23*b*. Both the delivery roller 23*a* and the delivery roller 23*b* may be actuated in synchronism. The delivery roller 23*a* may be actuated to drive the delivery roller 23*b*. The delivery roller 23*b* may be replaced by a pressure belt.

MODIFICATION OF INK-RIBBON DRIVE MECHANISM

Figure 12:
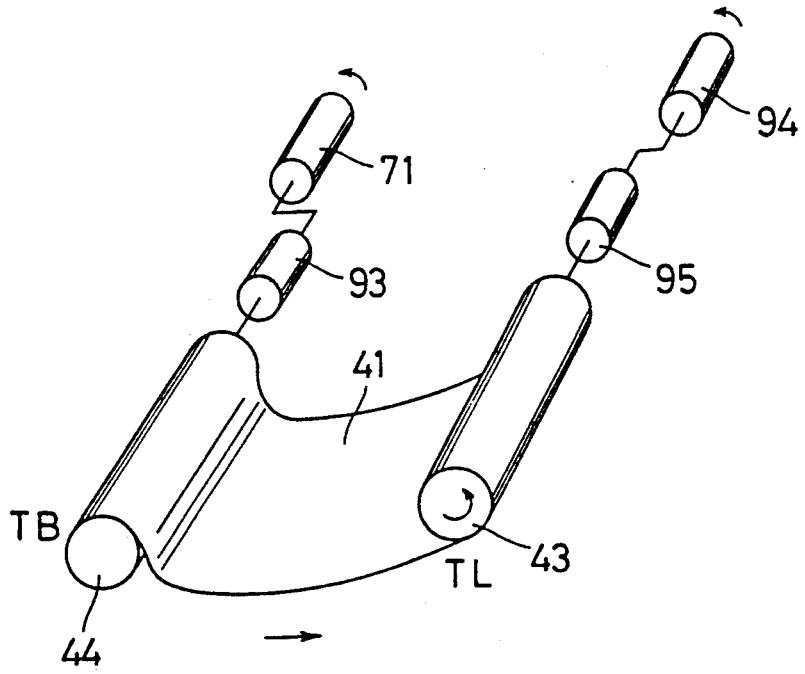
FIG. 12 is a schematic perspective view showing another example of the drive mechanism for an ink-ribbon.
Figure 13:
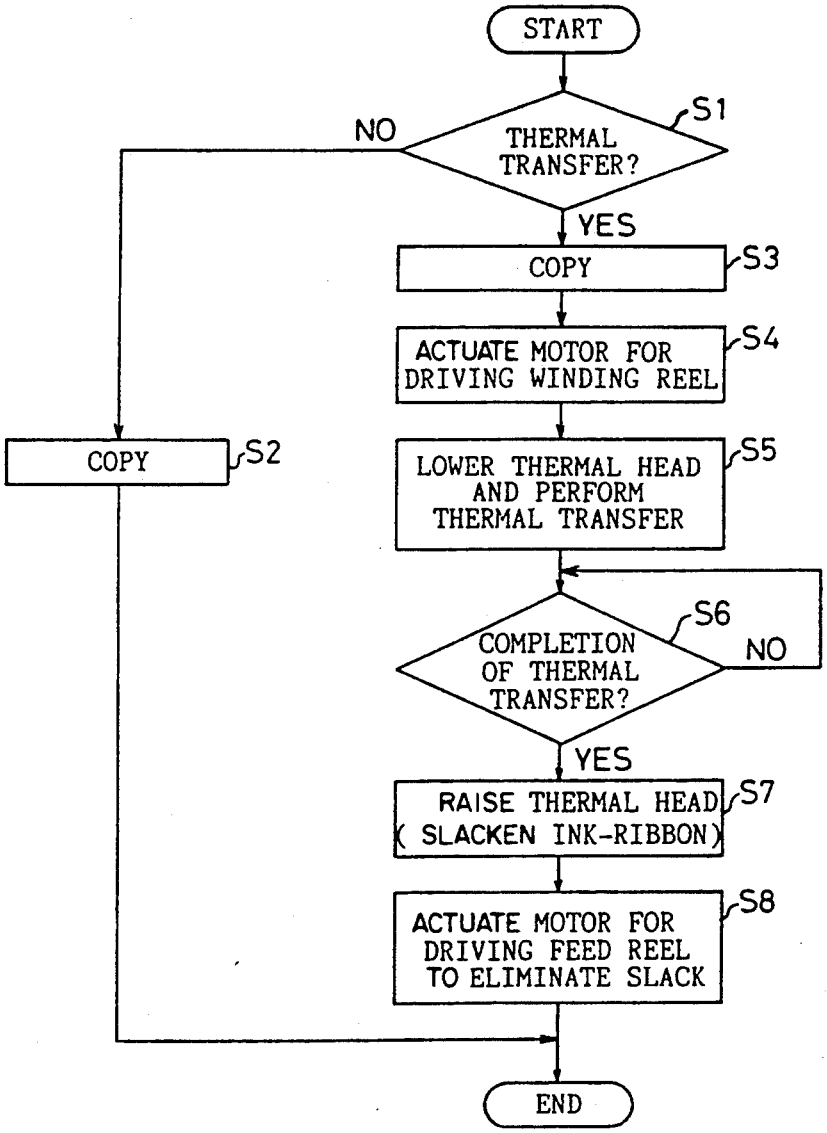
FIG. 13 is a flow chart showing the operation of the drive mechanism for an ink-ribbon.

FIG. 12 and FIG. 13 show another example of the ink-ribbon drive mechanism 7. The example in FIG. 7 eliminates ribbon slack by winding ink-ribbon 41 on winding reel 44, whereas the example in FIG. 12 eliminates ribbon slack by winding the ink-ribbon 41 on feed reel 43. In the example in FIG. 12, a ribbon-slack eliminating means comprises a motor 94 for driving the feed reel 43. A torque limiter 95 is provided between the motor 94 and the feed reel 43. A resistance loading means 93 is provided between drive motor 71 and the winding reel 44.

The torque limiter 95 has the same structure as the torque limiter 72 mentioned above, wherein torque is regulated so that no more than a predetermined amount TL of drive torque may be transmitted from the motor 94 to the feed reel 43.

The resistance loading means 93 loads the braking torque TB equal to or greater than the predetermined torque TL of the torque limiter 95 on the winding reel 44. Thus, this avoids the motor 94 winding the ink-ribbon 41 in a length more than necessary for eliminating the slack of the ink-ribbon 41. The resistance loading means 93 comprises a solenoid (not shown) whose claw portion can be engaged with a gear portion (not shown) provided on the shaft of the winding reel 44, and the engagement inhibits reverse turning of the winding reel 44 when the motor 94 starts winding to eliminate the ribbon slack.

According to the flow chart in FIG. 13, the operation of thermal transfer printer 2 and a copying machine will be described.

In step S1, whether thermal transferring is to be performed or not is determined. If thermal transferring is not to be performed, copying is performed, and step S2 is completed. If thermal transferring is to be performed, copying is conducted in step S3 first. Then the motor 71 for driving winding reel 44 is started (step S4). The thermal head 5 is lowered to be pressed to the paper on the platen roller 26, thus conducting thermal transferring (step S5). At the completion of the thermal transferring (step S6), the thermal head 5 is raised to the pressure release position, thus leaving the ink-ribbon slack (step S7).

Next, the motor 94, as the slack eliminating means, is started to wind the ink-ribbon 41 on the feed reel 44, thereby eliminating the slack in the ink-ribbon 41 (step S8). At this time, the ink-ribbon 41 is placed in tension, and the drive torque of the motor 94 is applied to the winding reel 44 through the ink-ribbon 41 so that the ink-ribbon 41 will be drawn from the winding reel 44. However, the resistance loading means 93 applies a braking torque TB greater than the predetermined torque TL of the torque limiter 95, and therefore, the ink-ribbon 41 is prevented from being drawn out from the winding reel 44. Accordingly, only the ribbon-slack is eliminated.

WINDING CONTROL MEANS

Figure 14:
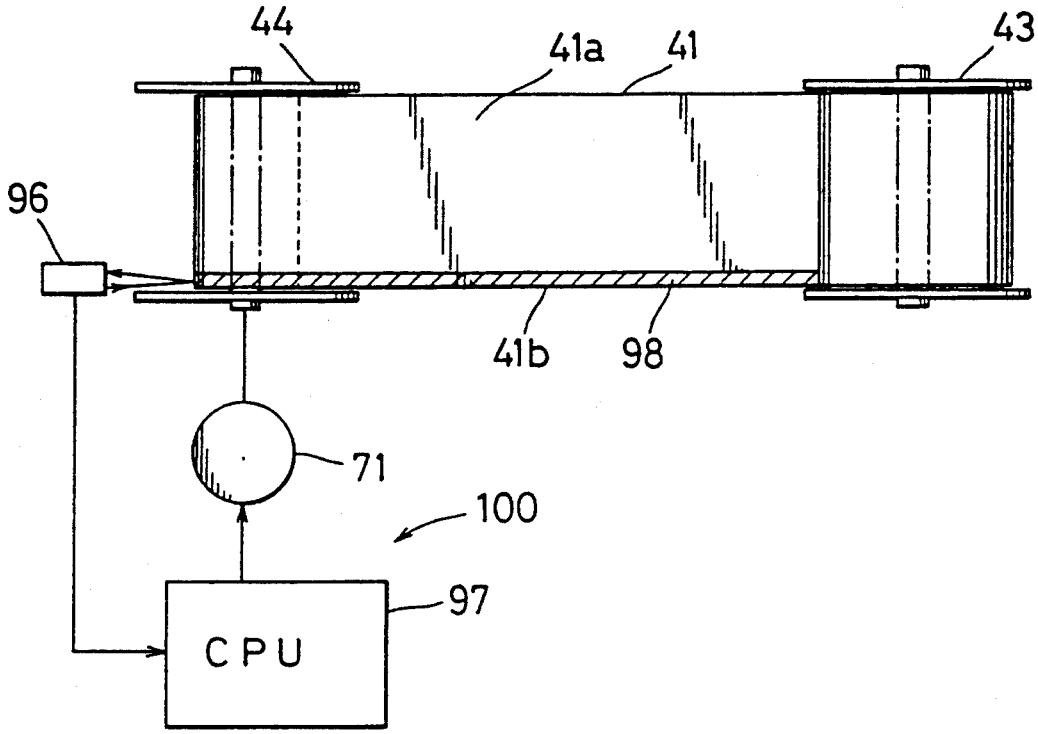
FIG. 14 is a schematic plan view showing the main portion of a winding control means.
Figure 15:
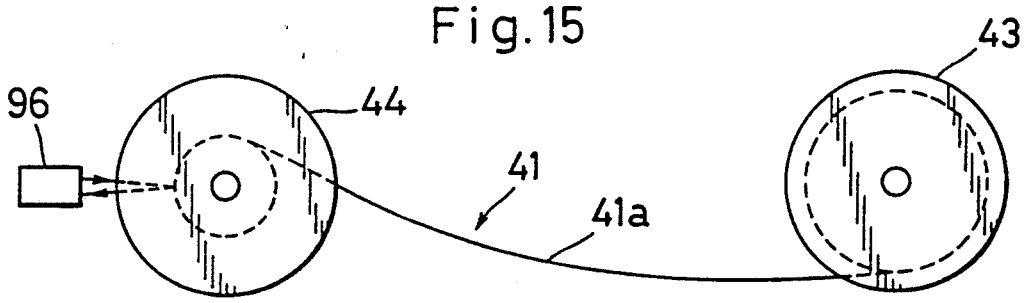
FIG. 15 is a schematic side view showing the main portion of a winding control means.

A winding control means 100 assures that a uniform length of the ink-ribbon 41 is wound in eliminating the slack in the ink-ribbon 41. Referring to FIG. 14 and FIG. 15, the winding control means 100 includes a photosensor 96 serving as an ink-ribbon length detection means and a winding time control means 97.

The photosensor 96 is disposed in the vicinity of winding reel 44 so as to detect relative change in the diameter of the ink-ribbon 41 wound on the winding reel 44. The winding time control means 97 comprises a CPU for controlling the driving time of drive motor 71 for the winding reel 44 according to a detection signal from the photosensor 96.

Along an edge portion **41*b* of the surface 41*a* of the ink-ribbon 41 opposite to the surface on which the ink is applied, there is provided a silver evaporation portion 98** as a light reflection surface.

The photosensor 96 irradiates light on the silver evaporation portion 98 of the ink-ribbon 41 wound on the winding reel 44, thus sensing changes in the amount of the reflected light. As the distance between the photosensor 96 and the silver evaporation portion 98 becomes shorter, the photosensor 96 receives a greater amount of reflected light. The distance between the photosensor 96 and the silver evaporation portion 98 is proportional to the amount of the ink-ribbon 41 on the winding reel 44.

Figure 16:
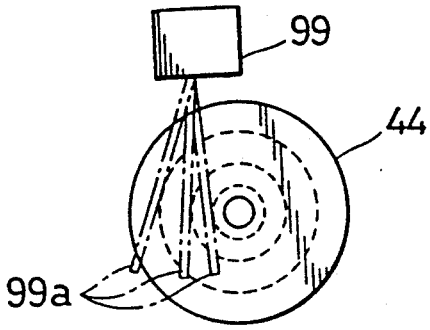
FIG. 16 is a schematic side view showing the main portion of another example of a ribbon amount detection means.

A microswitch 99 having an actuator **99*a* may be used in the place of the photosensor 96, as shown in FIG. 16. The microswitch 99 is a switch which is adapted to change its resistance value as the actuator 99*a*** pivots to change its position, thereby to induce an output corresponding to the diameter of the ink-ribbon wound on the reel.

The winding time control means 97 conducts calculations based on the detection output from the photosensor 96 and changes the drive time of the motor 71. Thus, the length of the ink-ribbon to be wound for eliminating slack is made uniform when the motor 71 drives the winding reel 44.

The photosensor 96 may detect the diameter of the ink-ribbon wound on the feed reel 43, or in other words, the remaining amount of the ink-ribbon 41. In this case, it is required to provide the silver evaporation portion 98 on the ink-ribbon side where the ink is applied. If the ink-ribbon 41 has a relatively large width, such as approximately 10 cm, a narrow silver evaporation portion 98 provided along the side thereof will not cause any detrimental influence on thermal transferring.

Furthermore, if the side whereon ink is applied or the side opposite to that side has a uniform reflectivity, the photosensor 96 can detect the diameter of the ribbon wound on the reel without providing the silver evaporation portion 98 thereon.

MODIFICATION OF THE PAPER DELIVERY PORTION

Figure 22:
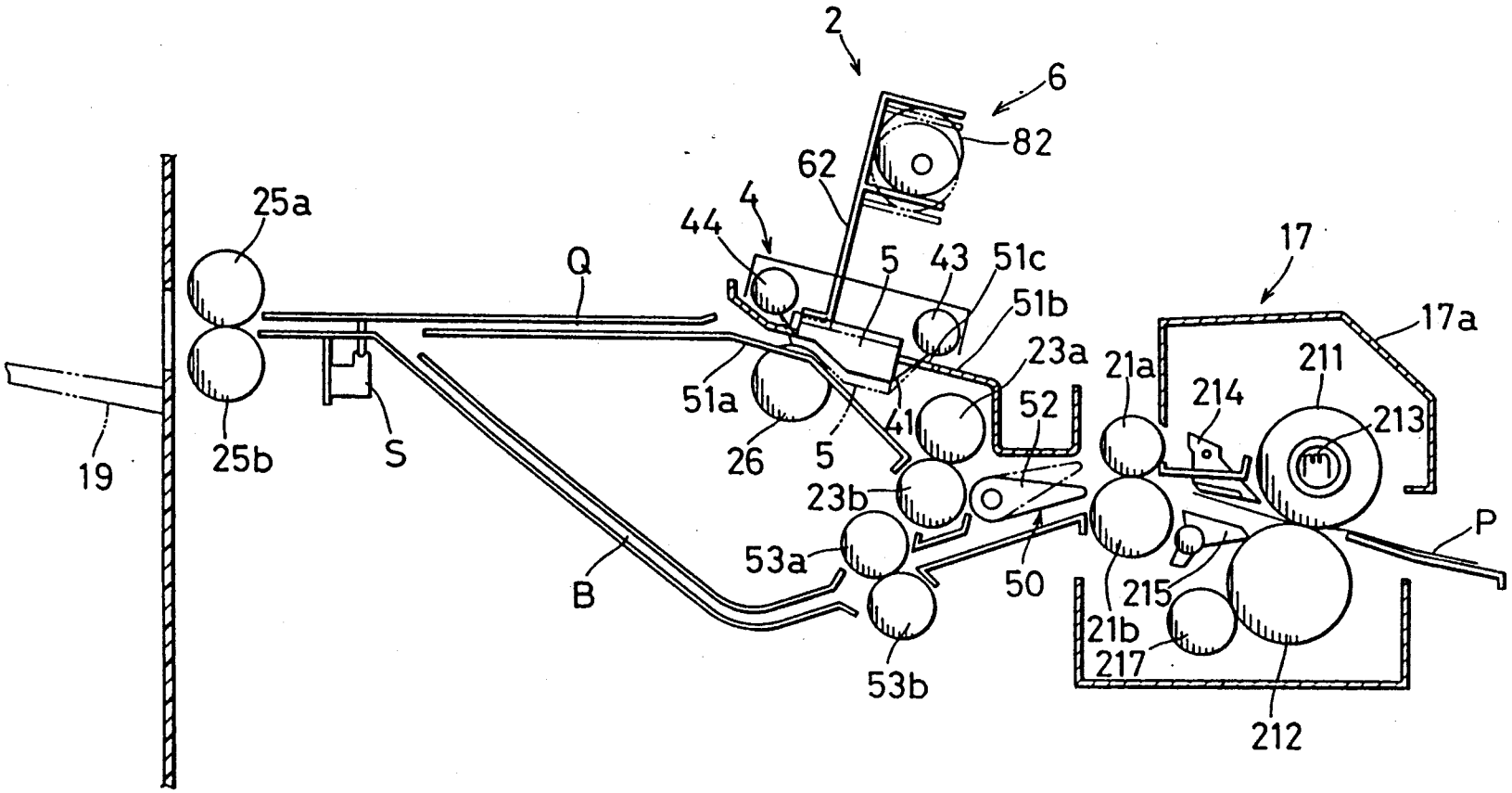
FIG. 22 is a schematic view showing a paper delivery portion.
Figure 23:
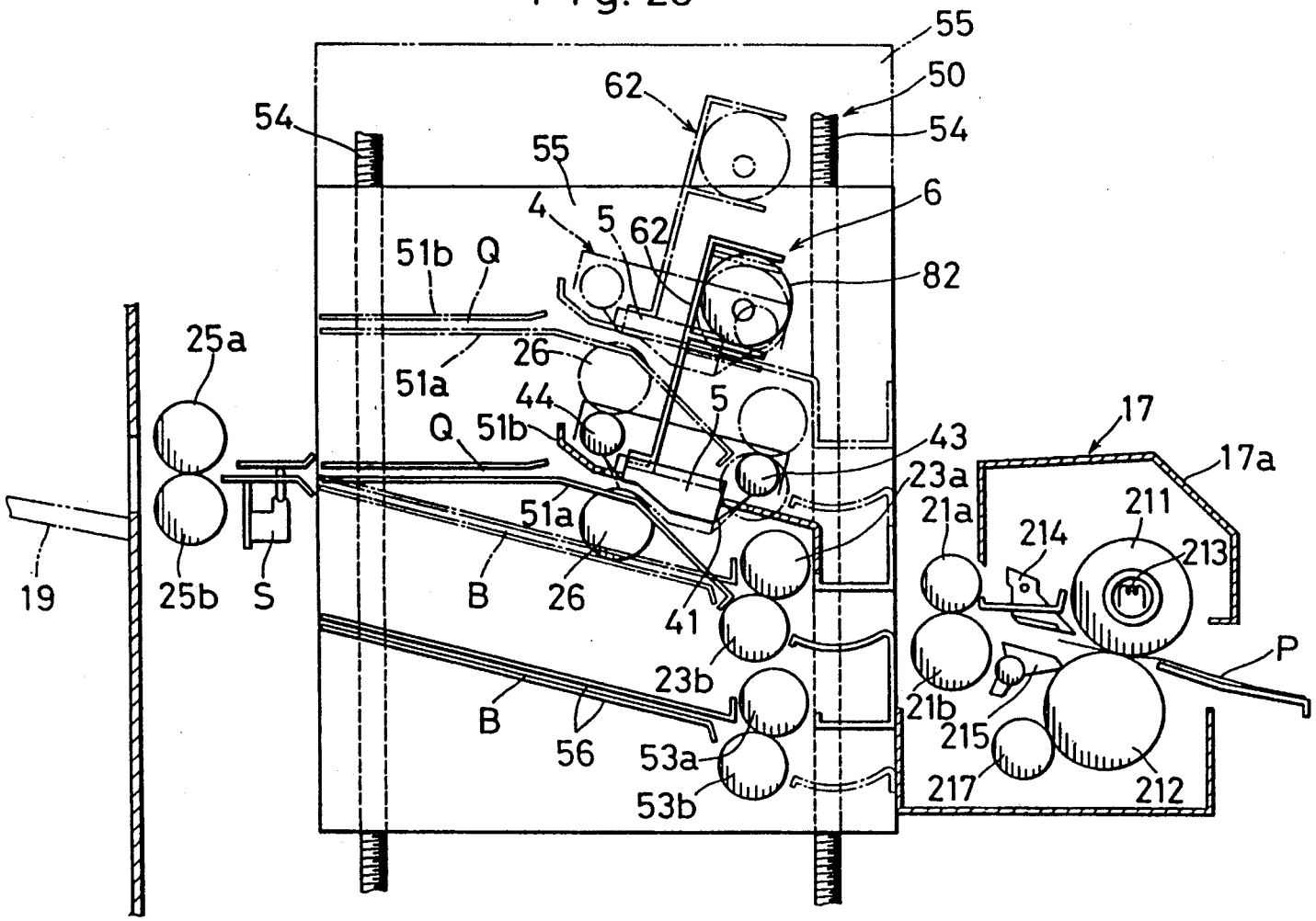
FIG. 23 is a schematic view showing another example of a paper delivery portion.

FIG. 22 and FIG. 23 respectively show modifications of the paper delivery portion 13. The paper delivery portion 13 according to the modifications includes a bypass B for guiding the paper discharged from the fixing device 17 to the discharge rollers **25*a*, 25*b* without passing through the thermal transfer printer 2, and a distributing means 50 which guides the paper from the fixing device 17 to the thermal transfer printer 2 when using the thermal transfer printer 2, and which guides the paper to bypass B when not using the thermal transfer printer 2**.

With reference to FIG. 22, the fixing device 17 fixes a toner image transferred on paper P delivered from a copy processing portion while catching the paper between a heat roller 211 and a pressure roller 212, thus conveying the paper to the downstream side in the delivery direction. A heater 213 is mounted inside the heat roller 211. There are provided respectively separation claws 214, 215 for separating the paper P, and a pair of delivery rollers **21*a*, 21*b* for discharging the paper P from the fixing device 17 on the downstream side in the delivery direction from the heat roller 211 and the pressure roller 212. In addition, an application roller 217 for applying an offset preventing agent such as silicon oil on the pressure roller 212 is brought in contact with the pressure roller 212. The heat roller 211 and pressure roller 212 or the like are housed in a casing 17*a***.

The thermal transfer printer 2 has the thermal head moving means 6 for extending and retracting the thermal head 5 disposed above the platen roller 26 opposite to the roller. The thermal head moving means 6 includes the eccentric roller 82 engaged with the fixing member 62 fixed with the thermal head 5.

A part of the circumference of the platen roller 26 extends into paper delivery passage Q through the lower guide plate **51*a* of two guide plates 51*a*, 51*b*** which define the paper delivery passage Q. The thermal head 5 extends into the paper delivery passage Q through a through-hole formed in the upper guide plate 51*b* of the two guide plates 51.

The distributing means 50 comprises a switching claw 52 disposed on the downstream side of the fixing device 17 in the delivery direction. The distributing means guides the paper P passing through the fixing device 17 to the thermal transfer printer 2 when a thermal transfer mode is selected by means of a keyboard not shown in the figure, and otherwise guides the paper P to the bypass B. The switching claw 52 is switched by a solenoid not shown in the figure.

Delivery rollers 23*a*, 23*b* are provided midway in the paper delivery passage Q, and delivery rollers 53*a*, 53*b* midway in the bypass B. The delivery rollers 23*a*, 23*b*, 53*a*, 53*b* convey the paper P to the discharge rollers 25*a*, 25*b*. A microswitch S is provided for checking discharge of the paper P.

According to the example in FIG. 22, of the paper P passing through the fixing device 17, only the paper P requiring thermal transferring is guided through the paper delivery passage Q to the discharge rollers 25*a*, 25*b*, and the paper P not requiring thermal transferring is guided through the bypass B to the discharge rollers 25*a*, 25*b*. Accordingly, the quantity of the paper P passing from the platen roller 26 to the thermal head 5 is reduced, and melting of the ink-ribbon due to radiant heat from the paper P is reduced. Therefore it is not necessary to provide a long stroke for the thermal head 5 to travel, which enables performance of thermal transferring in a shorter time. This also leads to faster copying operations.

The example in FIG. 23 differs from the example in FIG. 22 in that the paper delivery passage Q and the bypass B are raised up or lowered down in one piece, and either the delivery passage or the bypass B selectively connects the conveyor rollers 21*a*, 21*b* to the discharge rollers 25*a*, 25*b*.

Referring to FIG. 23, the paper delivery passage Q and the bypass B are provided in parallel. The thermal transfer printer 2, the paper guide plates 51*a*, 51*b*, defining the paper delivery passage Q, and a pair of guide plates 56*a*, 56*b*, defining the bypass B, are attached to a pair of side plates 55 movable upward or downward relative to the main body 1 of the copying machine. The side plates 55 are designed to be moved up or down by the distributing means 50. The distributing means 50 comprises a screw member 54 screwed in the side plates 55. The screw member 54 is driven by the drive system of the copying machine. The example in FIG. 23 has the same effect as the example in FIG. 22.

What is claimed is:

1. An image forming apparatus comprising:

a main body member having a side face, with an opening portion formed in said side face;

opening and shutting means for opening and shutting said opening portion;

a platen roller rotatably mounted in said main body member;

fixing means within said main body member for fixing a toner image on a paper;

a paper discharge portion mounted adjacent said side face for receipt of a paper discharged from said main body member after fixing of a toner image on the paper; and a thermal transfer printer for recording desired information additively on a paper on which a toner image has been fixed by said fixing means and which is positioned on the platen roller, said thermal transfer printer including:

(i) a cassette for housing an ink-ribbon, (ii) a casing having said cassette detachably mounted thereon, said casing being movable between a predetermined set position in the main body member and a retracted position retracted from the set position so as to allow said cassette to be removed from said image forming apparatus through said opening portion when said opening portion is kept open by said opening and shutting means, (iii) a thermal head;

(iv) thermal head supporting means for supporting said thermal head so that said thermal head is movable between a pressuring position, in which said thermal head presses an ink-ribbon housed in said cassette against the paper on said platen roller while extending the ink-ribbon from said cassette, and a retracted position retracted from the pressuring position so as to allow said cassette to be detached from said casing, and (v) an interlocking mechanism for causing said thermal head supporting means to retract said thermal head to the thermal head retracted position in response to movement of said casing to the casing retracted position.

2. The image forming apparatus according to claim 1, wherein said thermal transfer printer further includes a casing supporting shaft, said casing is pivotable about said casing supporting shaft between the set position and the casing retracted position, said thermal head is pivotably supported by said thermal head supporting means, and said interlocking mechanism pivots said thermal head away from said casing in response to pivoting of said casing to the casing retracted position.

3. The image forming apparatus according to claim 2, wherein said interlocking mechanism includes spring means operative through said thermal head supporting means for urging said thermal head to the thermal head retracted position.

4. The image forming apparatus according to claim 3, wherein said thermal transfer printer further includes a contact member connected with said main body, and wherein said thermal head supporting means is in contact with said contact member to control the position of said thermal head.

5. The image forming apparatus according to claim 4, wherein said contact member includes pivoting means for pivoting said thermal head supporting means to move said thermal head to the pressuring position and allowing said spring means to pivot said thermal head supporting means to move said thermal head away from the pressuring position.

6. The image forming apparatus according to claim 5, wherein said pivoting means includes an eccentric roller.

7. The image forming apparatus according to claim 6, wherein said pivoting means further includes a roller supporting shaft, wherein said eccentric roller has a shaft-inserting through hole through which said roller supporting shaft is inserted to allow said roller supporting shaft to move in the radial direction of said eccentric roller, and wherein said pivoting means further includes a compression spring within the shaft-inserting through hole for keeping the center of said eccentric roller away from said roller supporting shaft.

8. The image forming apparatus according to claim 3, wherein said spring means includes a tension spring engaged with the thermal head supporting means.

9. The image forming apparatus according to claim 3, wherein said spring means includes a torsion spring engaged with the thermal head supporting means.

10. The image forming apparatus according to claim 2, wherein said thermal head is integrally mounted with said thermal head supporting means for pivoting therewith, and said interlocking mechanism includes:

(i) a stay fixed to and pivotable with said thermal head supporting means, (ii) a guided member connected to said stay, and (iii) a guiding member attached to said main body member and adapted to be engaged by said guided member as said casing is pivoting from the set position to the casing retracted position, thus guiding the guided member to pivot said thermal head.

11. The image forming apparatus according to claim 10, further comprising an eccentric roller contacting said stay to move said thermal head to the pressuring position for thermal transferring.

12. The image forming apparatus according to claim 1, wherein said interlocking mechanism includes a spring means engaged with the thermal head supporting means.

13. The image forming apparatus according to claim 1, further comprising thermal head pivoting means for pivoting said thermal head to the pressuring position for thermal transferring.

14. The image forming apparatus according to claim 13, wherein said thermal head moving means includes an eccentric roller.

15. The image forming apparatus according to claim 14, wherein said thermal head pivoting means further includes a roller supporting shaft, wherein said eccentric roller has a shaft-inserting through hole through which said roller supporting shaft is inserted to allow said roller supporting shaft to move in the radial direction of said eccentric roller, and wherein said thermal head pivoting means further includes a compression spring within the shaft-inserting through hole for keeping the center of said eccentric roller away from said roller supporting shaft.

16. The image forming apparatus according to claim 1, wherein said cassette includes (i) a body, (ii) a feed reel and a winding reel mounted in parallel with each other in said body and (iii) an ink-ribbon, and wherein said ink-ribbon is adapted to be wound from said feed reel and wound on said winding reel.

17. The image forming apparatus according to claim 1, wherein said opening and shutting means includes a cover pivotably mounted on said main body of said image forming apparatus.

18. The image forming apparatus according to claim 17, wherein said cover includes a punching unit for punching filing holes in the paper.

19. The image forming apparatus according to claim 17, wherein said cover is connected with said paper discharging portion.

20. A thermal transfer printer for an image forming apparatus, for recording desired information additively on a paper on which the image forming apparatus has fixed a toner image, the image forming apparatus having a platen roller, said thermal transfer printer comprising:

(i) a cassette for housing an ink-ribbon and including a feed reel for feeding the ink-ribbon and a winding reel for taking up the ink-ribbon, (ii) a thermal head movable to a pressuring position in which said thermal head extends a portion of the ink-ribbon, located between said feed reel and said winding reel, from said cassette to press the portion on paper on the platen roller, for the purpose of thermal transferring and responsive to completion of the thermal transferring, to move to a pressure release position to release pressure from the portion of the ink-ribbon, (iii) ribbon-slack eliminating means responsive to said thermal head moving to the pressure release position for actuating said winding reel to wind the portion of the ink-ribbon thereon, thus eliminating slack in the ink-ribbon brought about by said thermal head moving to the pressure release position, and for releasing said winding reel following the winding of the portion of the ink ribbon thereon, (iv) a torque limiter for restraining said ribbon-slack eliminating means from transmitting more than a predetermined amount of torque to said winding reel, and (v) resistance loading means for loading on said feed reel an amount of braking torque greater than said predetermined amount of drive torque, whereby as slack is taken up after thermal transferring is completed, the braking torque inhibits ink-ribbon from being drawn out from said feed reel to said winding reel and when further desired information is recorded by subsequent moving of said thermal head to the pressuring position, a part of the portion of the ink ribbon wound on said winding reel in the eliminating of the slack is drawn out from said winding reel.

21. The thermal transfer printer according to claim 20 wherein said ribbon-slack eliminating means includes a stepper motor.

22. The thermal transfer printer according to claim 20, wherein said torque limiter includes:

(i) a first member interlocked and rotated with said ribbon-slack eliminating means, (ii) a second member disposed coaxially with said first member and interlocked and rotated with said winding reel, and (iii) urging means for urging said first and second members together, and wherein both said first member and second member are able to move axially and rotate relative to each other and have ends which face each other and which are urged into frictional engagement by said urging means.

23. The thermal transfer printer according to claim 20, wherein said resistance loading means includes a frictional member and urging means for elastically urging said frictional member to a predetermined position against said feed reel to generate a frictional force therebetween for braking rotation of said feed reel.

24. The thermal transfer printer according to claim 20, wherein said resistance loading means includes a solenoid having a claw portion, and a gear member provided on said feed reel for engagement with said claw portion.

25. The thermal transfer printer according to claim 20, further comprising thermal head moving means for selectively moving said thermal head to each of said pressuring position and said pressure release position.

26. The thermal transfer printer according to claim 25, further comprising a thermal head supporting shaft supporting said thermal head and integrally pivotable therewith, and wherein said thermal head moving means comprises:

(i) urging means for urging said thermal head to the pressure release position, and (ii) pivoting means for pivoting said thermal head supporting shaft to pivot said thermal head to the pressuring position against the force of said urging means, and for allowing said urging means to pivot said thermal head to the pressure release position after completion of thermal transferring.

27. The thermal transfer printer according to claim 26, wherein said pivoting means includes an eccentric roller, and a member extending in the radial direction of said thermal head supporting shaft and pivotable with said thermal head supporting shaft.

28. The thermal transfer printer according to claim 27, further comprising a casing mounting said cassette, a casing supporting shaft supporting said casing, and a roller supporting shaft parallel with said casing supporting shaft, and wherein said eccentric roller is provided with a shaft-inserting through hole said roller supporting shaft is inserted in such a manner as to allow said roller supporting shaft to move in the radial direction thereof, and said eccentric roller includes a compression coil spring in the shaft-inserting through hole for keeping the center of the eccentric roller away from the roller supporting shaft.

29. A thermal transfer printer for an image forming apparatus, for recording desired information additively on a paper on which the image forming apparatus has fixed a toner image, the image forming apparatus having a platen roller, said thermal transfer printer comprising:

(i) a cassette for housing an ink-ribbon and including a feed reel for feeding the ink-ribbon and a winding reel for taking up the ink-ribbon, (ii) a thermal head movable to a pressuring position in which said thermal head extends a portion of the ink-ribbon, located between said feed reel and said winding reel, from said cassette to press the portion on paper on the platen roller, for the purpose of thermal transferring and responsive to completion of the thermal transferring, to move to a pressure release position to release pressure from the portion of the ink-ribbon, (iii) ribbon-slack eliminating means responsive to said thermal head moving to the pressure release position for actuating said feed reel to wind the portion of the ink-ribbon thereon, thus eliminating slack in the ink-ribbon brought about by said thermal head moving to the pressure release position, and for releasing said winding reel following the winding of the portion of the ink ribbon thereon, (iv) a torque limiter for restraining said ribbon-slack eliminating means from transmitting more than a predetermined amount of torque to said feed reel, and (v) resistance loading means for loading on said winding reel an amount of braking torque greater than said predetermined amount of torque, whereby as slack is taken up after thermal transferring is completed, the braking torque inhibits ink-ribbon from being drawn out from said winding reel and when further desired information is recorded by subsequent moving of said thermal head to the pressuring position, a part of the portion of the ink ribbon wound on said feed reel in the eliminating of the slack is drawn out from said feed reel.

30. The thermal transfer printer according to claim 29, wherein said ribbon-slack eliminating means includes a stepper motor.

31. The thermal transfer printer according to claim 29, wherein said torque limiter includes:

(i) a first member interlocked and rotated with said ribbon-slack eliminating means, (ii) a second member disposed coaxially with said first member and interlocked and rotated with said feed reel, and (iii) urging means for urging said first and second members together, and wherein both said first member and second member are able to move axially and rotate relative to each other and have ends which face each other and are urged into frictional engagement by said urging means.

32. The thermal transfer printer according to claim 29, wherein said resistance loading means comprises a solenoid having a claw portion, and a gear member provided on said feed reel for engagement with said claw portion.

33. A winding controller for controlling taking up of slack in an ink-ribbon of a thermal transfer printer in an image forming apparatus, following thermal transferring of desired information additively on a paper on which the image forming apparatus has fixed a toner image, the thermal transfer printer including a feed reel for feeding the ink-ribbon and a winding reel for winding of the ink-ribbon after the thermal transferring, said winding controller comprising:

ribbon amount detecting means for detecting either an amount of ribbon remaining on said feed reel or an amount of ribbon wound on said winding reel and providing an amount signal indicative of the detected amount, and winding time control means responsive to the amount signal for changing the winding time of the winding reel in accordance with the detected amount to cause a constant length of ribbon to be wound onto said winding reel after each thermal transfer regardless of the amount of ribbon on said feed reel and said winding reel.

34. The controller according to claim 33, wherein:

said winding time control means controls winding of ink-ribbon including a light reflecting strip along one side edge thereof, and said ribbon amount detecting means includes a light source for irradiating light on the light reflecting strip of the ink-ribbon wound on either the feed reel or the winding reel, and a detector for detecting the light reflected from the light reflecting strip to detect relative changes in the diameter of the ribbon wound on the associated reel.

35. The controller according to claim 34, wherein said light reflecting strip comprises a silver evaporation portion formed on one surface of the ink-ribbon.

36. The controller according to claim 34, wherein said detector comprises a photosensor for receiving light reflected from the reflecting strip.

37. The controller according to claim 33, wherein the ribbon amount detecting means comprises a microswitch having an actuator which is elastically urged against the circumference of the ink-ribbon wound on either the feed reel or the winding reel and which moves according to changes in the diameter of the ink-ribbon, the microswitch outputting a signal corresponding to the position of said actuator.

38. An image forming apparatus comprising:

fixing means for fixing a toner image on a paper;

a thermal transfer printer for recording desired information additively on the paper after the toner image has been fixed thereon;

a pair of side plates a pipe of high heat conductivity and having end portions supported by said pair of side plates;

pressuring means for interposing paper discharged from said fixing means into a clearance between said pressuring means and said pipe, thus pressing the paper to said pipe;

driving means for driving at least one of said pipe and said pressuring means to cause said pipe and said pressuring means to deliver the paper to the thermal transfer printer; and ventilating means for causing external air to flow through said pipe to cool said pipe and the paper.

39. The image forming apparatus according to claim 38, wherein said pipe is made of aluminum.

40. The image forming apparatus according to claim 39, wherein said pressuring means comprises either a roller or a belt, and urging means elastically urging said roller or belt to said pipe.

41. The image forming apparatus according to claim 38, wherein said pressuring means includes a roller, said roller including (i) an aluminum supporter having a plurality of hollow portions extending in the axial direction, and (ii) a frictional member provided on the circumference of the supporter.

42. The image forming apparatus according to claim 38, wherein said ventilating means includes an intake fan or a blow-in fan.

43. The image forming apparatus according to claim 38, further comprising static electricity removing means for removing static electricity in said pipe.

44. The image forming apparatus according to claim 43, wherein said static electricity removing means is connected with the side plates and has a brush contact shoe for contacting the circumference of the pipe.

* * * * *